United States Patent [19]

Wilcox et al.

[11] 4,361,065

[45] Nov. 30, 1982

[54] INTEGRATED CENTRAL PROCESSOR FOR ELECTRONIC ORGAN

[75] Inventors: Brian N. Wilcox, Kettering, Ohio; John W. Robinson, Jasper, Ind.

[73] Assignee: Kimball International Inc., Jasper, Ind.

[21] Appl. No.: 234,001

[22] Filed: Feb. 12, 1981

Related U.S. Application Data

[63] Continuation of Ser. No. 962,400, Nov. 20, 1978, abandoned.

[51] Int. Cl.[3] ..... G10H 1/38; G10H 1/42

[52] U.S. Cl. ..... 84/1.03; 84/1.17; 84/115; 84/DIG. 12; 84/DIG. 22

[58] Field of Search ..... 84/1.01, 1.03, 1.17, 84/115, DIG. 11, DIG. 12, DIG. 22; 340/365 R, 365 S

[56] References Cited

U.S. PATENT DOCUMENTS

| | | | |
|---|---|---|---|
| 3,746,773 | 7/1973 | Uetrecht | 84/1.01 |
| 3,929,051 | 12/1975 | Moore | 84/1.17 |
| 3,955,460 | 5/1976 | Southard | 84/1.17 |
| 3,990,339 | 11/1976 | Robinson et al. | 84/1.17 |
| 3,992,973 | 11/1976 | Howell | 84/DIG. 11 |
| 4,022,098 | 5/1977 | Deutsch et al. | 84/1.03 |
| 4,023,456 | 5/1977 | Groeschel | 84/115 |
| 4,108,037 | 8/1978 | Robinson et al. | 84/1.03 |
| 4,112,802 | 9/1978 | Robinson et al. | 84/1.01 |
| 4,120,225 | 10/1978 | Dietrich et al. | 84/1.03 |
| 4,144,787 | 3/1979 | Robinson et al. | 84/1.01 |
| 4,147,085 | 4/1979 | Robinson et al. | 84/1.17 |

*Primary Examiner*—Stanley J. Witkowski

*Attorney, Agent, or Firm*—Albert L. Jeffers; John F. Hoffman

[57] ABSTRACT

A central processor for an electronic organ in the form of a single, forty pin integrated circuit chip employing multiplexed technology and trinary and tri-level inputs to obtain maximum usage from each pin. The solo manual keys, chord keys, rhythm pattern switches and other control functions are multiplexed externally of the chip, fed into the chip as a time division multiplexed four bit byte over four pins, and demultiplexed internally of the chip. The solo manual information is multiplexed internally of the chip to form a single serial data stream, is combined with solo fill note data generated within the chip and then brought out over a single pin for external demultiplexing. The twelve tones of a musical octave are brought into the chip over twelve pins together with various static control signals, are decoded by tri-level decoders internally of the chip, and then utilized to generate the tones of the chords, also internally of the chip. Chord tone generation is accomplished by selecting the musical fifth tone in an internal ROM, dividing this tone by a factor of three to produce the fundamental and generating the third and seventh tones also through the use of internal ROMs. Keying of the chord tones is accomplished by internal digital sustain keyers which provide an output over a single pin. There is also provided internally of the chip the capability for producing bass patterns, note patterns and rhythm percussion patterns. By suitable controls, the chip may be adapted for use in a large organ configuration, where various of the timing controls are generated externally, and in a small organ configuration, where these controls are generated internally of the chip.

17 Claims, 17 Drawing Figures

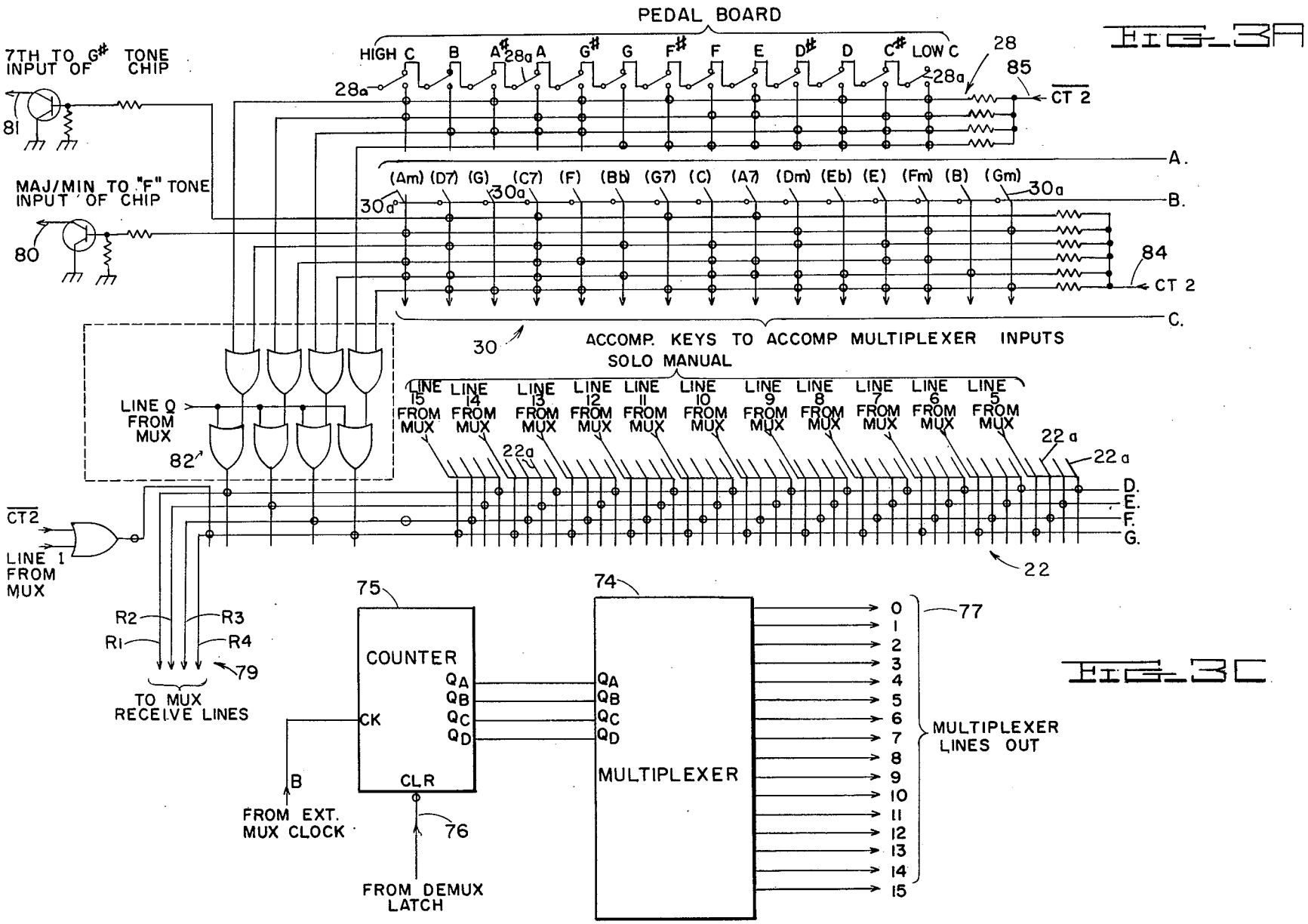
PEDAL BOARD
HIGH C
B
A#
A
G#
G
F#
F
E
D#
D
C#
LOW C
28
28a
85
CT 2
84
30a
(Am) (D7) (G) (C7) (F) (Bb) (G7) (C) (A7) (Dm) (Eb) (E) (Fm) (B) (Gm)
A.
B.
C.
D.
E.
F.
G.
ACCOMP. KEYS TO ACCOMP MULTIPLEXER INPUTS
SOLO MANUAL
30
22
22a
LINE 15 FROM MUX
LINE 14 FROM MUX
LINE 13 FROM MUX
LINE 12 FROM MUX
LINE 11 FROM MUX
LINE 10 FROM MUX
LINE 9 FROM MUX
LINE 8 FROM MUX
LINE 7 FROM MUX
LINE 6 FROM MUX
LINE 5 FROM MUX
MULTIPLEXER LINES OUT
77
0 1 2 3 4 5 6 7 8 9 10 11 12 13 14 15
MULTIPLEXER
74
QA QB QC QD
COUNTER
75
CLR
CK
76
FROM DEMUX LATCH
B
FROM EXT. MUX CLOCK
R1 R2 R3 R4
79
TO MUX RECEIVE LINES
82
LINE 0 FROM MUX
CT2
LINE 1 FROM MUX
7TH TO G# OF INPUT TONE CHIP
81
MAJ/MIN TO "F" TONE INPUT OF CHIP
80

ENABLE COUNTS 0-44
89a
GATE
92
SOLO DATA
MULTIPLEX RECEIVER
89
R1
R2
R3
R4
A
B
CHORD WORD
PEDAL SUSTAIN
NOTE PATTERN ON/OFF
SOLO CHORD ON/OFF
CT 2
88
12 RHYTHM PATTERN SELECTS
88a
88b
88c
88d
88e
CK
LATCH ENABLE
90
C
D
E
F

104
FILL NOTE ROM (216)
12 LINES
18 LINES
(9) 1 OF 2 DATA SELECTORS
9 LINES
122a
10 BIT S-R
106
12 BIT SR (RECIRCULATING)
102
OR MIX
103
MAJ/MIN
123

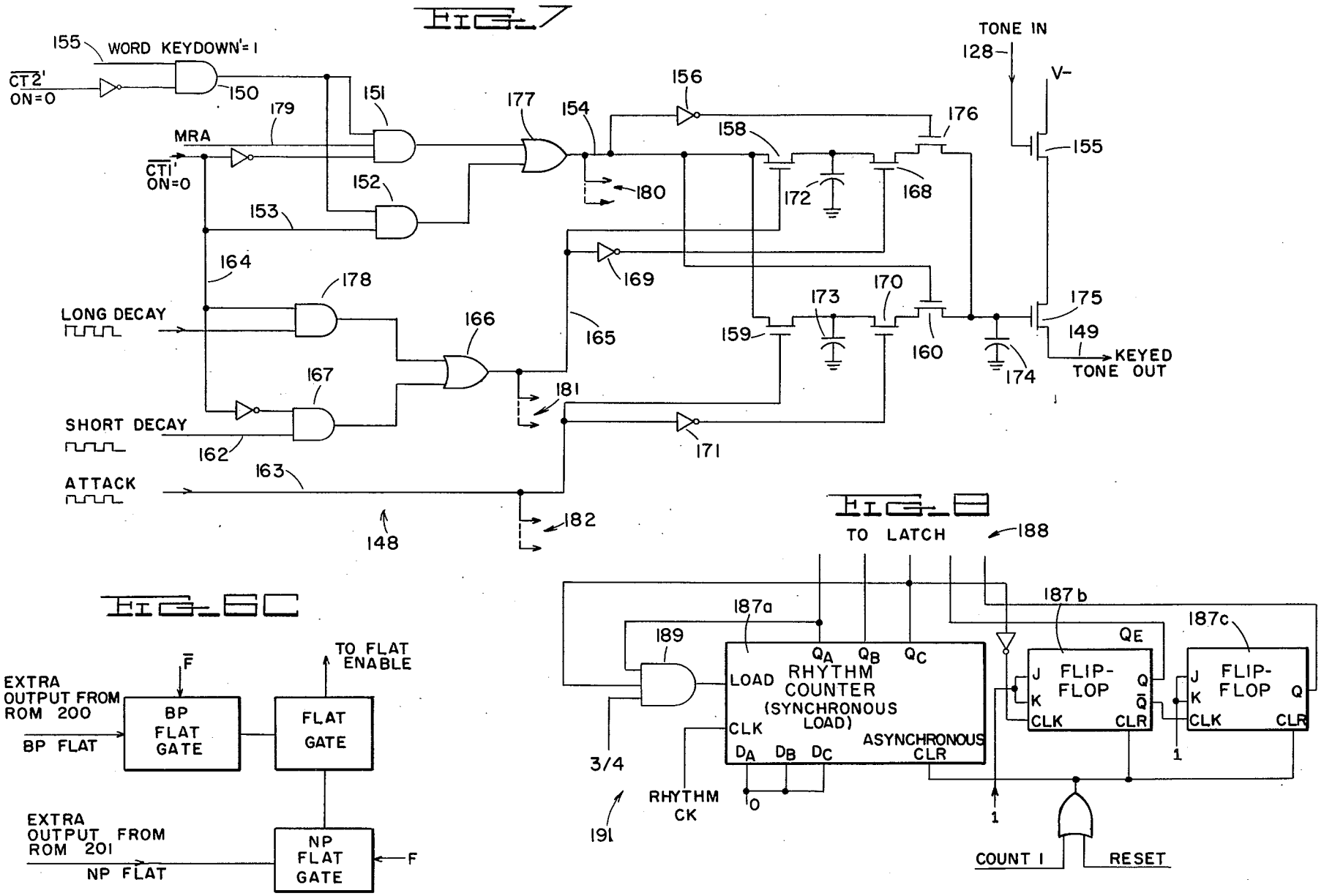
TONE IN
128
V-
155
175
149
KEYED TONE OUT
174
176
168
160
170
172
173
158
159
156
171
180
169
165
154
177
181
182
166
151
152
178
167
148
179
153
163
150
164
162
WORD KEYDOWN'=1
MRA
CT1' ON=0
CT2' ON=0
LONG DECAY
SHORT DECAY
ATTACK
TO LATCH
188
187c
FLIP-FLOP
J K CLK CLR Q
1
QE
187b
FLIP-FLOP
Q̄
RESET
COUNT I
1
RHYTHM COUNTER (SYNCHRONOUS LOAD)
ASYNCHRONOUS CLR
QA QB QC
DA DB DC
LOAD CLK
187a
0
RHYTHM CK
189
3/4
191
TO FLAT ENABLE
FLAT GATE
NP FLAT GATE
F
F̄
BP FLAT GATE
EXTRA OUTPUT FROM ROM 200
BP FLAT
EXTRA OUTPUT FROM ROM 201
NP FLAT ENCODER
288
291
290
289
45
NOTE PATTERN SELECT SWITCHES
FROM 7TH
FROM MAJ/MIN
FROM CTI
FROM WORD KD
FROM RHYTHM ON/OFF
81
80
295
34
TONE/CONTROL INPUTS
AUTO-MAN C
LARGE/SMALL C#
RHYTHM ON D
WORD KD D#
CTI E
MAJ/MIN F
BPO F#
BPI G
7TH G#
NPO A
NPI A#
NP2 B
AUTO/MAN SELECT
294
293
292
44
BASS PATTERN SWITCHES
LATIN
ROCK
BOOGIE
C C# D D# E F F# G G# A A# B
TONES

INTEGRATED CENTRAL PROCESSOR FOR ELECTRONIC ORGAN

This is a continuation, of application Ser. No. 962,400, filed Nov. 20, 1978, and now abandoned.

BACKGROUND OF THE INVENTION

The present invention relates to electronic organs and in particular to multi-purpose single chip LSI in which the complex data processing for the organ is accomplished.

With the advent of solid state electronics and the rapid growth of digital logic, it has become possible to perform many complex functions in connection with the operation of electronic organs and other electronic instruments. Whereas in the past very little was available in the way of automatic play features, the state of the art has now progressed to the point where even neophyte organists can play compositions previously playable only by much more advanced musicians. For example, many present day organs include circuitry for automatically playing fill notes in the solo manual simply by depressing a single chord playing key in the accompaniment manual and a single key in the solo manual. Furthermore, various note patterns on the solo and accompaniment manuals and bass patterns on the pedalboard can be stored in memories and recalled by the performer simply by playing the desired chord.

Heretofore, the electronics for such "easy play" features has been extremely complex and to reduce the difficulty and cost of manufacturing and servicing, there has been a steadily increasing trend toward integrating many of the circuit elements such as read only memories, dividers, individual keyers, etc. Although in some cases even major sub-systems of the organ have been integrated, the practical limitation of being able to obtain integrated circuit chips having no more than forty pins has proved to be an impediment to larger scale integration.

SUMMARY OF THE INVENTION

In the present invention, large scale integration of nearly all the complex logic and data processing involved in modern electronic organs has been accomplished on a single, forty pin integrated circuit chip. This has been accomplished through the use of tri-level and trinary decoders whereby more than one signal can be brought into a digital system over a single pin, and through the use of time division multiplexing a multiple bit byte for the keyboards, rhythm pattern selection and various other control signals.

The chip offers internally stored and processed bass and keyboard patterns, solo fill note generation, automatic chord processing and an internal rhythm unit. Through the use of internal tone ROMs, forty-eight chords can be provided, the tones for which are fed out of the chip over a single pin. A semi-serial type four bit byte multiplexing scheme is utilized to retrieve manual data and other control information to supplement the normal pin inputs to the chip for information acquisition and distribution as well as pattern selection for the rhythm unit.

The chord system processes the tones at the input frequency level and all logic conversion is accomplished with these frequencies. The musical fifth is derived in a tone ROM and then processed in a divide-by-three divider circuit to obtain the fundamental. The musical third and musical seventh tones are also derived in internal ROMs with major/minor selection and a seventh selection being obtained from two tri-level inputs.

Chord or pedal root information is conveyed in by the multiplexed four bit byte which controls the chord generation and also the bass pattern and note pattern generation. Internal keyers are controlled by internal functions such as musical rhythm accompaniment pulses and word keydown signals. Digital sustain type keying is employed internally for attack and decay in the chord, note pattern, and bass pattern generation.

The note pattern and bass pattern generation is under the control of the four bit chord word and the tri-level major/minor select and their patterns are built upon that root under the control of the five bit rhythm counter and the pattern read only memories. The pattern memories each produce a four bit word which is added to the root word in a modulo 12 adder, which is time shared for dual use with both the bass pattern and note pattern generation. The bass pattern and note patterns are then decoded to select tones in separate tone ROMs and are further controlled for patterns used with minor chords by flatting the musical third when and if it occurs in the pattern.

Internal functions such as note pattern generation, bass pattern generation, automatic rhythm accompaniment keying and the like are controlled in the large organ mode by tri-level inputs calling for such functions. In the small organ mode, they are controlled by a word keydown command generated internally under the control of a single trinary input to the chip.

The solo fill note system employs a six bit magnitude comparator to interject predetermined chord start information, which is determined by the four bit binary word brought in on the multiplexed data streams, into a twelve bit recirculating shift register having serial-to-parallel output to a solo fill note read only memory. This ROM then feeds a ten bit shift register having nine input lines which loads the parallel data in proper placement so that when it is shifted out in serial form, the solo chord fill notes are sounded in the octave below the original solo note which initially enabled the solo fill note system.

An auxiliary multiplexer internally of the chip multiplexes a plurality of internally generated control signals which are fed out on a single pin to an external demultiplexer comprising D type flip flops.

Specifically, the present invention comprises an electronic organ having multiplexer means for scanning the keys and generating a plurality of concurrent parallel time division multiplexed serial data streams each comprising time slots corresponding on a one-to-one basis to the keys of diverse portions of the keyboard and each containing keydown signals corresponding to actuated keys of their respective portions of the keyboard.

The invention further contemplates an electronic organ comprising a chord keyboard having keys which correspond respectively to a plurality of chords playable by the organ and called forth by the respective keys, means responsive to the actuation of any one of the keys for developing a chord playing signal unique to the chord called forth by the actuated key, tone generating means responsive to the chord playing signal for producing a tone having a pitch corresponding to the musical fifth of a chord, divider means for dividing the musical fifth tone by a factor of three to produce a tone having a pitch corresponding approximately to the fundamental of the chord, means responsive to the chord playing signal for producing a tone having a pitch corresponding to the musical third of the chord, and means for combining the fundamental, musical third, musical fifth and musical seventh tones.

The system further includes a solo fill note generating system incorporated in an electronic organ including a keyboard having playing keys for calling forth respective tones and comprising a solo portion and an accompaniment portion, a clock for producing a train of clock pulses, a multiplexer for scanning at least the solo portion of the keyboard in synchronism with the clock and generating a data stream on each scan of the keyboard containing keydown signals in respective time slots for each depressed key in the solo manual. The solo fill note generating system is operable in response to an initiating keydown signal in the data stream and the depression of a key in the accompaniment portion for supplying at least one keydown signal to the data stream in a fill note time slot different from the time slot pertaining to the respective keydown signal and wherein the time slot corresponds to a key which is octavely related to a key corresponding to the tone called forth by the depressed accompaniment key. The improvement in the solo fill note generating system comprises a multistage second shift register clocked in synchronism with the scanning of the keyboard and having an output feeding into the data stream and having respective inputs for at least some of its stages, a multistage first shift register clocked in synchronism with the scanning of the keyboard wherein each of the stages has an output line, means synchronized with the scanning of the keyboard and responsive to the depression of the key in the accompaniment manual for loading a data bit into the first shift register, and a memory having a plurality of input lines connected respectively to the first shift register output lines, and a plurality of output lines connected respectively to the stages of the second shift register input, address points sequentially addressed by the first shift register over the memory input lines and loading the data bit into at least one stage of the second shift register when the initiating keydown signal appears in the data stream.

Note pattern and bass pattern generation is accomplished by a system comprising: a root word generator for generating a multiple bit binary root word in response to the particular chord key which is depressed, a first memory having a plurality of multiple bit binary words stored therein and having addressing inputs and outputs, a second memory having a plurality of multiple bit binary words stored therein and also having addressing inputs and outputs, means for addressing the first and second memory inputs for generating first and second series of binary words sequentially according to a predetermined rhythmic pattern at the outputs of the first and second memories, respectively, an arithmetic logic unit connected to receive the root word as a first input, time sharing control means for alternately connecting the first and second series of binary words to a second input of the arithmetic logic unit, said arithmetic logic unit having an output which is either the sum or difference of the binary words at its inputs, selectively updated first tone means connected to the output of the arithmetic logic unit for producing a tone corresponding to the output thereof, selectively updated second tone means connected to the output of the arithmetic logic unit for producing a tone corresponding to the output thereof, and means for alternately updating the first and second tone means in synchronism with the time sharing control means such that when the first series of binary words is connected to the arithmetic logic unit, the first tone means is updated, and when the second series of binary words is connected to the arithmetic logic unit, the second tone means is updated.

BRIEF DESCRIPTION OF THE DRAWINGS

FIGS. 3A, 3B and 3C are circuit schematics of the keyboards and the external multiplexer;

FIG. 6C is a modification;

FIG. 7 is a detailed circuit schematic of one of the sustain keyers;

FIG. 9 is a diagrammatic representation of the internal auxiliary multiplexer;

DETAILED DESCRIPTION

Figure 1:
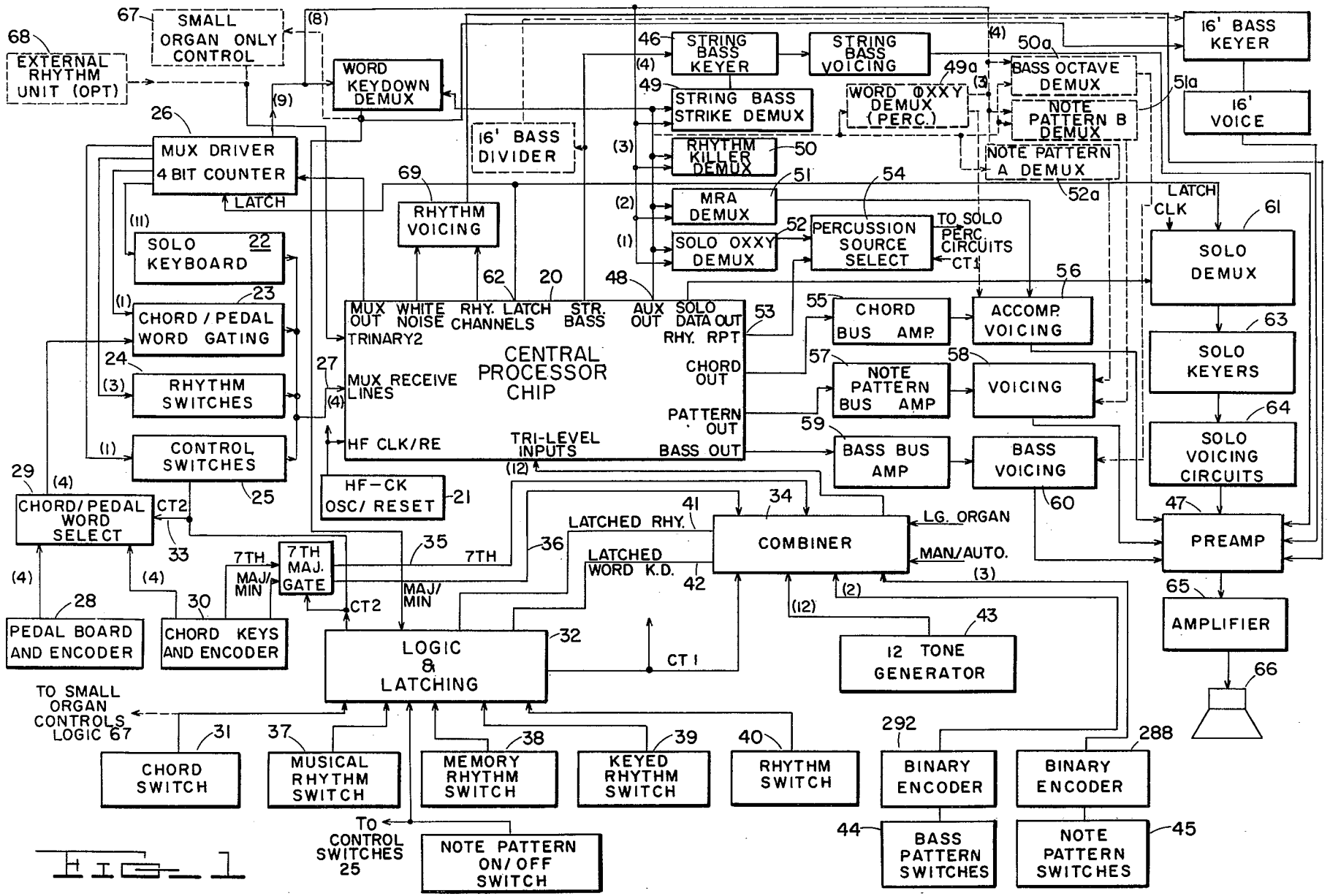
FIG. 1 is an overall block diagram of the system according to the present invention.

Referring now to the drawings in detail, the overall system is shown in FIG. 1. The CPU for the organ comprises a single 40 pin chip 20 which is adaptable for use in either a large organ configuration, where control features are supplied in circuits external to the CPU, as well as in a small organ configuration in which control features are not supplied external to the CPU, but must be generated internally of chip 20.

Clocking for the chip 20 is brought in on a pin from high frequency clock 21 and, since this pin has an internal trinary decoder, the master reset signal may also be brought in at this point. The solo keyboard 22, the pedal and chord words from block 23, the 12 rhythm select switches 24, and the chord, solo chord, note pattern and pedal sustain control switches 25 are multiplexed by driver 26 and brought into chip 20 as a four bit byte on pins 27. One of the pedalboard and encoder 28 and the chord keys and encoder 30 are selected in block 29 and fed to chord/pedal word gating 23. If the organ is in the "chord" mode, in which chords are automatically played upon the depression of certain keys in the accompaniment manual, the pedalboard will be disabled. When the organ is placed in the chord mode by actuating chord switch 31 (the organ will always be in the chord mode when small organ configuration is selected,) a CT2 signal will be produced by logic and latching circuit 32 and fed to chord/pedal select circuit 29 over line 33 as well as to other points in the system for control purposes. If a seventh chord or a minor chord is selected on the accompaniment manual 30 when the organ is in the chord mode, appropriate select signals will be fed to combiner circuit 34 over lines 35 and 36, respectively.

Musical rhythm switch 37 is fed into logic and latching block 32 and, when actuated, causes the normal accompaniment and pedals to assume the role of enabling devices permitting the generation of musical rhythm accompaniment (MRA) pulses which are used to strobe tones in synchronism with the rhythm unit. Memory rhythm switch 38 is also fed to logic and latching circuit 32 and when it is actuated, the rhythm unit is silenced until an accompaniment key or pedal (in the non-chord mode) is depressed at which point the rhythm unit will start. If the material rhythm switch is actuated, the rhythm unit will pulse the accompaniment and pedal tones at the rhythm MRA rate. Rhythm and pedal tones continue to play after the pedal is released, but the accompaniment ceases (in the non-chord mode) as soon as the accompaniment keys are released. Keyed rhythm switch 39 is also fed to logic and latching circuit 32 and when actuated, causes the rhythm unit to start playing when any pedal or accompaniment key is depressed, except when in the chords mode in which case only the depression of a chord effective accompaniment key will cause the rhythm unit to start. Accompaniment is discontinued when the key is released and the rhythm and pedals continue to play for approximately one second after the pedal is released. Rhythm switch 40, which is connected to logic and latching circuit 32, when actuated in conjunction with musical rhythm switch 37, turns the rhythm on continuously and MRA is available to pulse any pedal or accompaniment signal.

The twelve tones from tone generator 43 are combined with: the latched rhythm signal on line 41, the latched word keydown signal on line 42, the binary encoded signal representing the actuated bass pattern switch 44, the binary encoded signal represented the actuated note pattern switch 45, and the seventh and major/minor signals from chord key encoder 30. A line to place the system in the large organ mode is also fed to combiner circuit 34 as well as a manual/automatic select line. The outputs from combiner circuit 34 and fed to chip 20 over twelve tri-level inputs shared with the twelve tones of the highest octave.

A string bass tone, characteristically having a duty cycle of thirty-seven and one-half percent, is fed to string bass keyer 46 and a signal produced thereby is voiced and fed to preamp 47. Various output control signals are fed out of chip 20 on the "Auxiliary Out" pin 48 is multiplexed form and are demultiplexed by a series of D-type flip flops 49, 49*a*, 50, 50*a*, 51, 51*a*, and 52, 52*a* corresponding to string bass/strike, word oxxy, rhythm killer, which shuts the rhythm off, bass octave select and MRA pulse, note pattern octave selects and the solo oxxy pulse, the latter being a keydown signal. Other external control signals such as word keydown, note pattern octave selects and bass octave selects may also be multiplexed out, with D flip flops being provided only to the extent necessary.

The rhythm repeat signal from pin 53 is combined with the solo oxxy signal in percussion source select block 54, which also has a CT1 input, which is generally an MRA enable signal. The chord tones are fed from chip 20 to chord bus amp 55 after which they are voiced in voicing circuits 56 and fed to preamp 47. The note pattern tones are fed to bus amp 57, voiced in voicing circuits 58 and also fed to preamp 47. The bass tones are fed to bass bus amp 59, voiced in voicing circuits 60 and fed to preamp 47. The solo data is fed out of chip 20 in time division multiplexed form and is demultiplexed in demultiplexer 61, which receives a latch signal from "latch out" pin 62. Solo keyers 63 are actuated in accordance with the demultiplexed data, the tones are voiced in circuits 64 and fed to preamp 47. Power amplifier 65 has an output to speaker 66. With the system in the small organ configuration, separate small organ control block 67 is provided. In the large organ mode, an optional external rhythm unit 68 may be utilized to replace or supplement the internal rhythm unit. The internal rhythm signals are obtained from the white noise and rhythm voice channel pins and voiced in six separate voicing circuits 69 prior to being fed to preamp 47.

Figure 2:
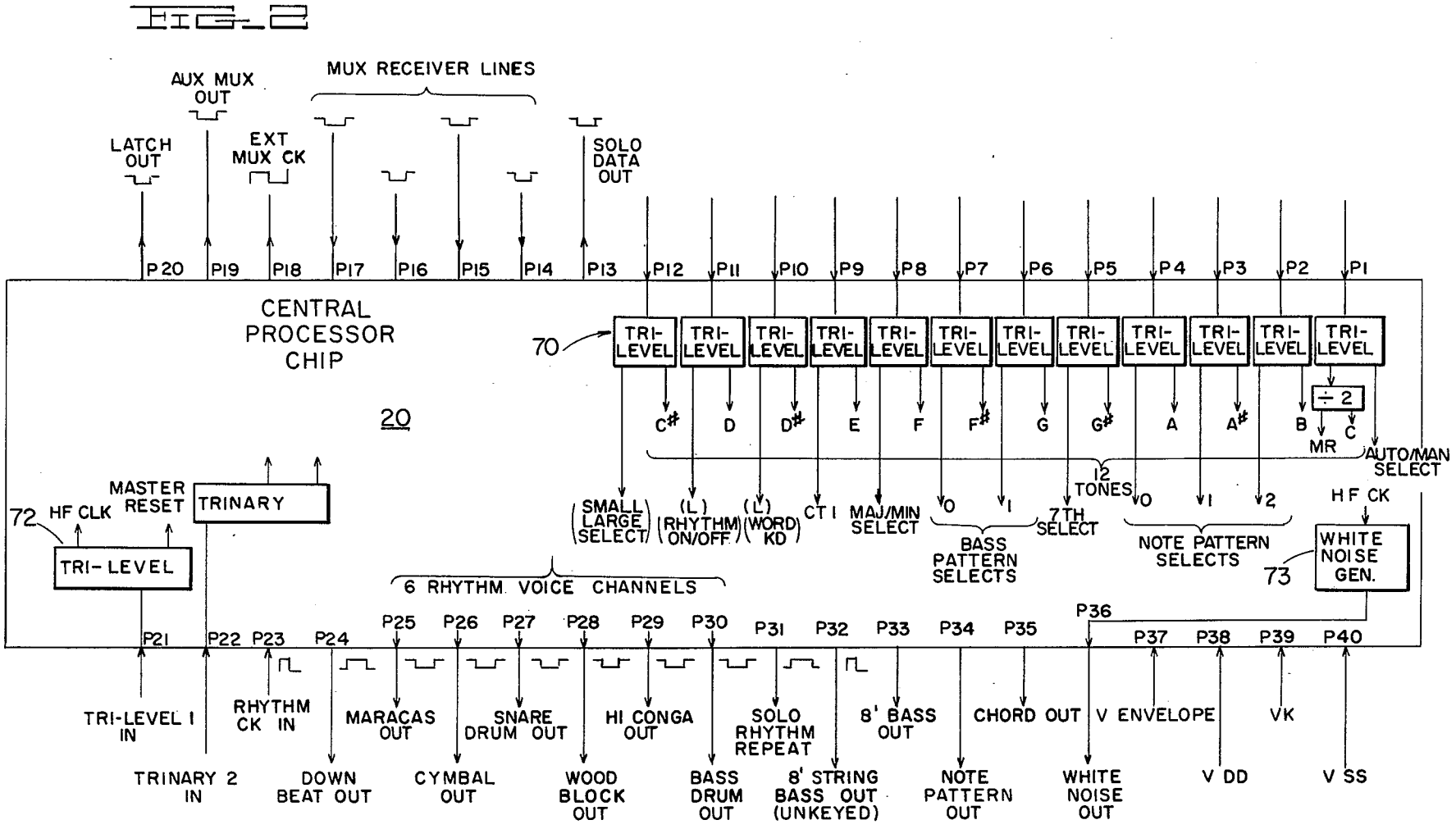
FIG. 2 is a diagrammatic representation of the processor chip showing the inputs and outputs thereof.

Referring now to FIG. 2, the inputs and outputs for chip 20 are shown in greater detail. It will be seen that pins P1 through P12 are tri-level inputs receiving the respective twelve pitches of the highest octave together with a variety of control signals. A tri-level input circuit such as circuit 70 for the C# tone and the small/large organ select line is well known in the art and is utilized where a dynamic input, such as a periodic tone signal, is combined with a relatively static signal. For example, permitting the tone to swing from plus five volts to 0 volts at the tone frequency would indicate a logic 0 on line 71 pertaining to the small/large organ select. By causing the tone to swing from plus five volts to minus nine volts at the C# frequency conveys a logic 1 signal on line 71. Thus, the tone information for C# together with the small/large organ select information can be brought into chip 20 on a single pin by means of tri-level decoding.

On pin P1, the C tone is brought in together with the automatic/manual select signal. On pins P2, P3 and P4, the B, A# and A tones are brought in together with the three bit binary word denoting which note pattern is selected by the performer. Pin P5 brings in the G# tone together with the seventh chord select from chord key encoder 30 (FIG. 1) whereas pin P8 combines the F tone with the major/minor select from encoder 30. Pins P6 and P7 combine the G and F# tones with the two bit binary word representing the bass pattern which was selected by the performer. It might be noted at this point that the note pattern and bass pattern referred to are rhythmic patterns of notes sounding as if they are played on the keyboard and pedals respectively, which are permanently stored in memories in the organ and played selectively by the performer simply by selecting a particular chord key with the appropriate note pattern and/or bass pattern tab actuated.

On pin P9, the E tone is combined with the CT1 command, on pin P10 are combined the D# tone with the word keydown signal, and on pin P11 are combined the D tone and the rhythm on/off signal. The word keydown and rhythm off signals are brought into chip 20 when the system is used in the large organ configuration, since the rhythm pulses and word keydown pulses will be generated by the external organ circuitry and need not be generated internally within the chip.

The multiplexed four bit byte is brought into chip 20 on pins P14–P17 and the multiplexed solo data out is provided on pin P13. Pins P18, P19 and P20 carry the external multiplexer clock, multiplexed auxiliary data stream out, and latch out signals, respectively.

Pin P21 includes a trinary decoder 72 and carries the high frequency clock pulses together with the master reset pulse. A trinary input is an input which has three possible levels of logic 0, 1 and 0/1 corresponding to three voltage levels, for example, +5 v., −9 v. and 0v.

For example, the input signal can convey high frequency clock information by swinging between +5 v. and 0 v. at the clock frequency, and when it swings to −9 v., this would indicate a master reset pulse. Pin P22 which is designated "Trinary 2" conveys "rhythm on" and "musical rhythm on" (CT1 on) in the logic 0/1 state, "rhythm off" and "musical rhythm on" in the logic 0 state, and "rhythm on" but "musical rhythm off" in the logic 1 state.

The rhythm clock pulses are brought in on pin P23 and the downbeat pulse, which is the first beat of each rhythm measure is brought out on pin P24. Pins P15–P30 provide the various rhythm voices which are voiced externally of the chip, pin P31 carries the solo rhythm repeat pulse, pin 32 carries the unkeyed 8' string bass output, pin 33 carries the 8' bass out, pin 34 carries the note pattern tones, pin 35 carries the chord tones, and pin 36 is a white noise output which is generated in white noise generator 73. Generator 73 is clocked by a high frequency clock pulse train and comprises a 17 stage polynominal counter. Pins 37–40 are the voltage supply inputs for the chip.

Figure 3B:
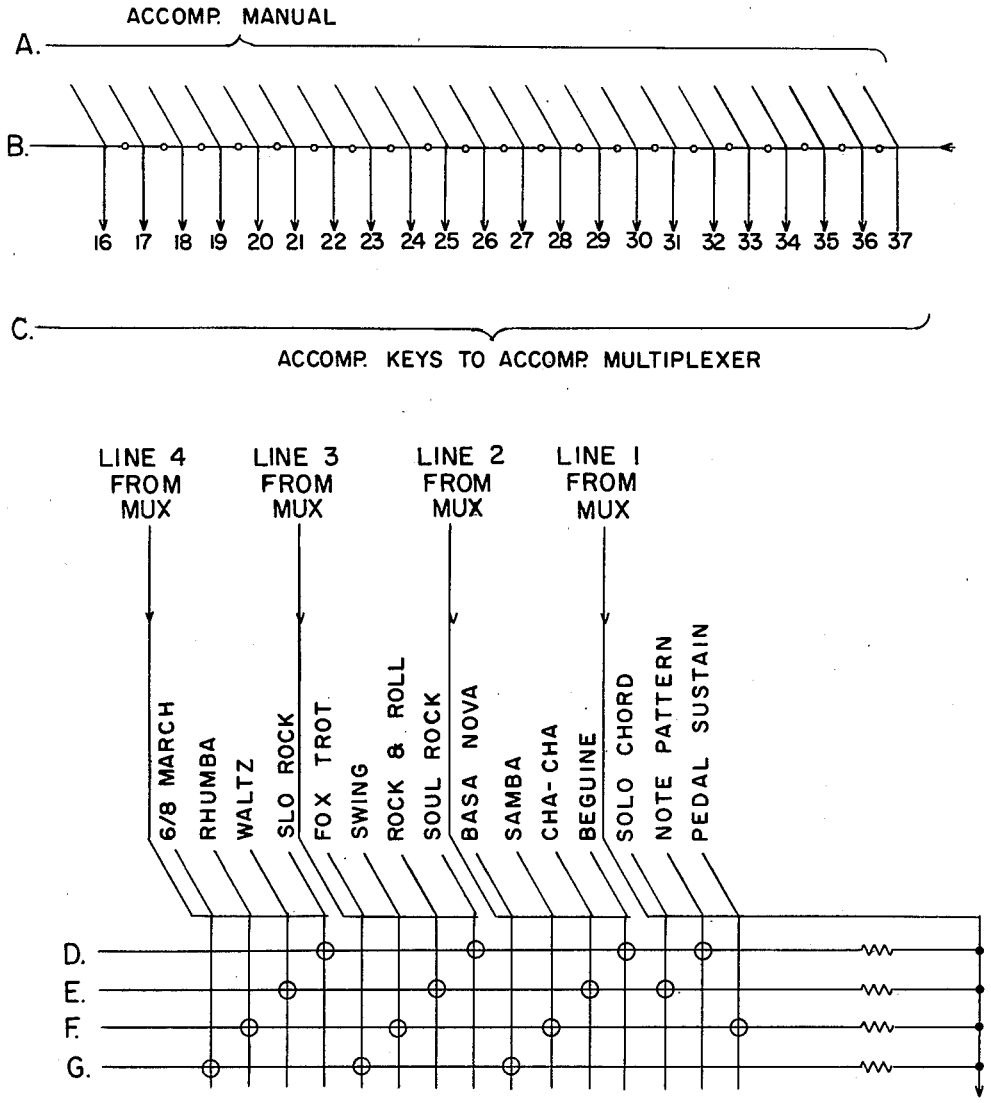

The pedalboard 28 customarily played by the feet, accompaniment manual 30 customarily played by the left hand, solo manual 22 customarily played by the right hand and multiplexer therefor are shown in FIGS. 3A, 3B and 3C. In the case of a single manual 30 organ, the "accompaniment manual" is the group of keys 30A normally played by the left hand. In most prior art plural manual organs, the accompaniment manual is physically separated from the solo manual, and is positioned generally vertically lower than the solo manual. Multiplexer 74 is driven by counter 75, which in turn is clocked by the external multiplex clock output P18 on chip 20. The latching signal is fed to counter 75 on line 76, which is connected to pin P20 of chip 20. Multiplexer 74 is in essence a one-of-sixteen decoder and provides sequential signals on its sixteen output lines 77. The keys **22*a* of solo manual 22 are multiplexed by lines 5 to 15 of multiplexer 74 and provides a four bit byte on multiplex receive lines 79 which are connected respectively to pins P14, P15, P16 and P17. The four bit byte relating to the chords selected on the accompaniment manual in the chord mode are brought into chip 20 in the appropriate time slot determined by line 0 from multiplexer 74. If the chord is a minor, an appropriate signal will appear on line 80 and if the chord is a seventh chord, the appropriate signal will appear on line 81. When line 0 from multiplexer 74 goes high, OR gates 82 will be unable to pass the four bit chord word from accompaniment manual 83. It will be noted that the presence of a CT2 signal on line 84 will enable the chord generation function of accompaniment manual 83 and the simultaneous existence of a $\overline{CT2}$ signal on line 85 will disable the pedalboard 28. Conversely, the absence of a CT2 signal will enable pedalboard 28 86 and disable the chord generating capability of accompaniment manual 83. The four bit byte representing the depressed pedal 28 is gated through OR gate 82 when the 0 line from multiplexer 74** goes low. When the organ is in the non-chord mode, the non-chord accompaniment keys are multiplexed by means of a separate accompaniment multiplexer (not shown).

Also fed into chip 20 over line 79 are the twelve rhythm select lines FIG. 3B, which are multiplexed by means of multiplexer lines 2, 3 and 4. Line 1 of multiplexer 74 relates to the solo chord select, note pattern select, and $\overline{CT2}$ signal.

Figure 4:
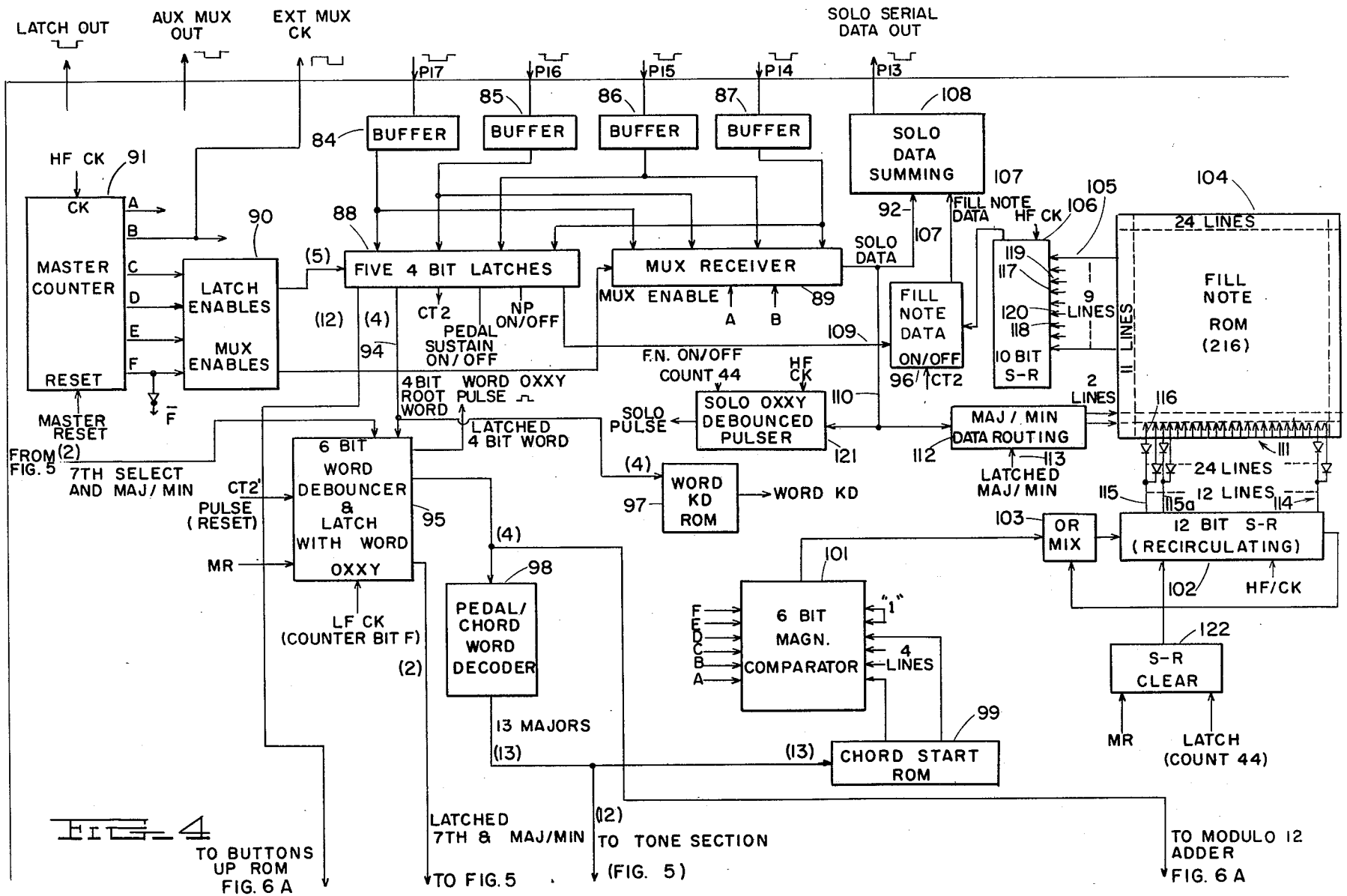
FIG. 4 is a more detailed block diagram of the multiplex receive system and the solo chord system.
Figures 4A, 4B:
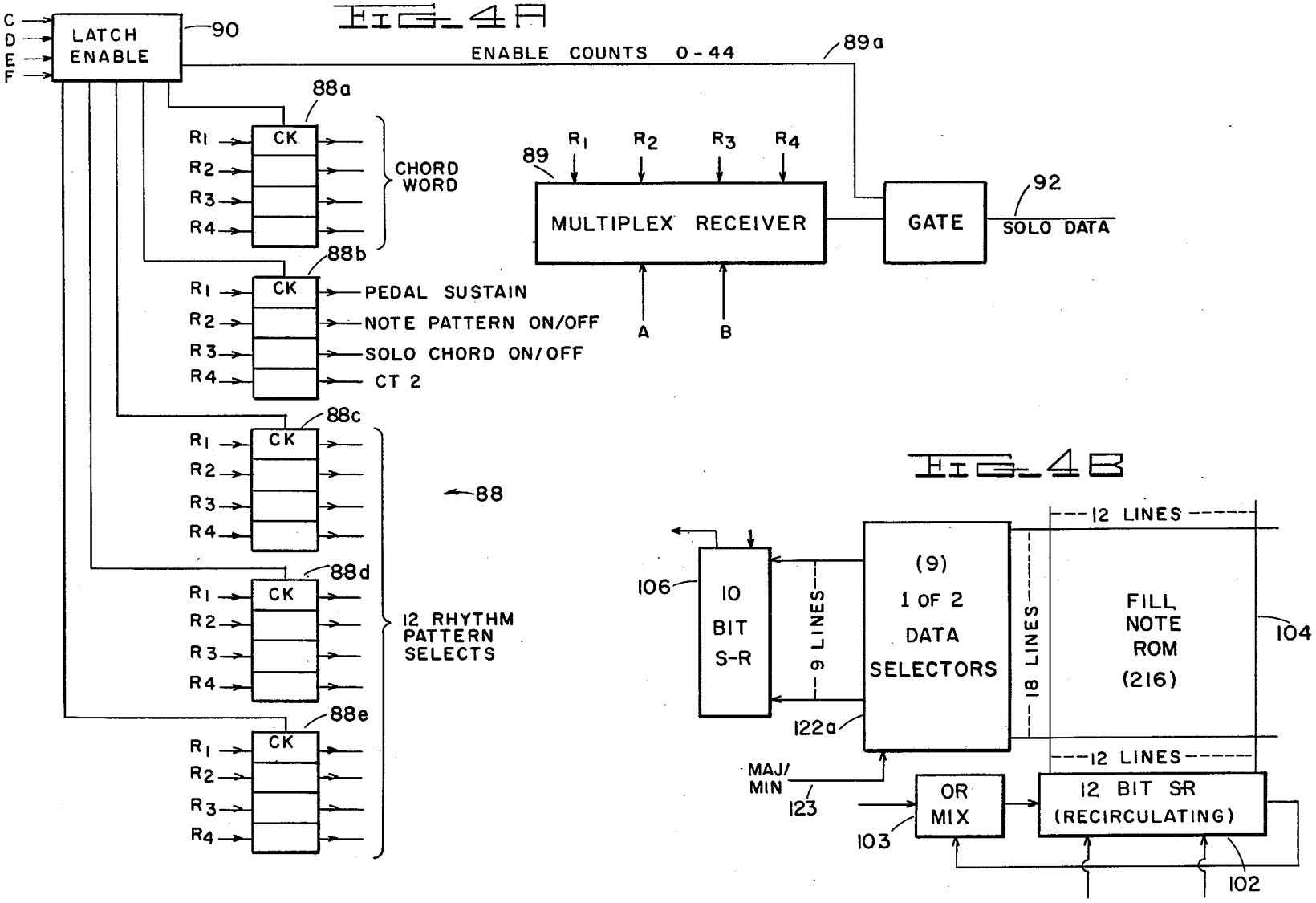
FIG. 4A is a more detailed block diagram of the internal demultiplexer.
FIG. 4B is modified form of the solo chord system.

Referring now to FIGS. 4 and 4A, the multiplexed four bit byte signal passes through four buffers 84, 85, 86 and 87 to five four-bit latches **88*a*, 88*b*, 88*c*, 88*d* and 88*e*. Latch 88*b* latches the solo fill note pattern, pedal sustain and CT2 signal, latch 88*a* latches the chord/pedal root word, and the three remaining latches 88*c*, 88*d* and 88*e*** latch the twelve rhythm selects.

Figure 6A:
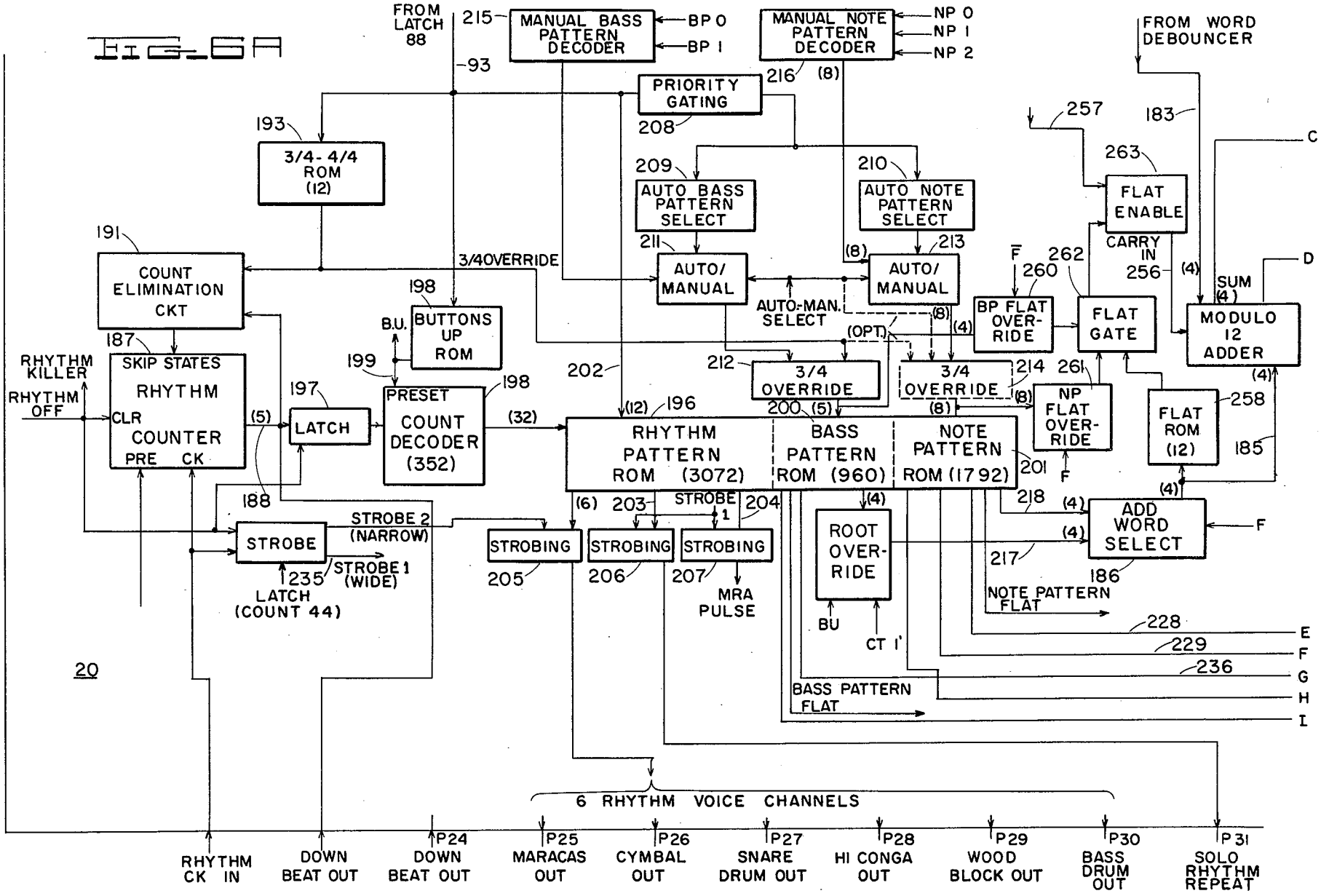
FIGS. 6A and 6B are more detailed block diagrams of the rhythm and pattern generation systems.

The outputs of buffers 84, 85, 86 and 87 are connected to multiplex receiver 89, which is driven by the least significant bits A and B of master counter 91 and which processes the solo data portion of the manual and is the first portion which is scanned. A signal over line **89*a* from multiplex enable 90 enables multiplex receiver 89 during the first 44 counts of master counter 91 and multiplex receiver 89 converts the parallel/serial data to a true serial data stream on line 92. At the end of the forty-fourth count of counter 91, latch enable 90 enables in sequence the five four bit latches 88, which are updated once during each scan of the manual. The twelve outputs 93 of the four bit rhythm latches are connected to the rhythm section. The four bit root word on lines 94 is fed to word debouncer 95 and to modulo 12 adder 184 (FIG. 6A). The solo fill note on/off signal is fed to block 96**.

In debouncer and latch 95, the four bit root word is latched and held for further processing. A ten millisecond pulse is also generated when any key is actuated; if the key is released, however, no pulse will occur. The low frequency clock input to circuit 95 is the timing for this pulse and of the debounce time. The CT2' pulse serves to reset latch 95. This prevents a pedal word from being mistaken for a chord word or vice versa, when the external switching is activated. A master reset pulse is fed to block 95 as it is to all blocks in the system and enables the system to start out in an initialized state.

It should be noted that multiplexer 74 (FIG. 3) is clocked by the B output, or binary 000010 output of counter 91 so that the scan rate is one-fourth that normally produced by clock 91.

The four bit root word from debouncer and latch 95 is fed to word keydown ROM 97 which is the equivalent of a negative logic AND gate which detects either a chord or no chord condition. The four bit root word also feeds a pedal/chord word decoder 98 which decodes the word into twelve roots and a thirteenth for the pedalboard 28, which comprises thirteen pedals **28*a*. The output of decoder 98 is connected to chord start ROM 99 which is employed in the solo fill note system, and also to the chord generating system shown in FIG. 5**.

The solo fill note system is of the dynamic type, as opposed to the static solo fill note system disclosed in U.S. Pat. No. 3,990,339. Its purpose, however, is the same: to automatically provide fill notes in the solo manual 22 in the octave immediately below the highest solo note played and corresponding to certain notes of the chord played in the accompaniment manual 30. The heart of the solo fill note system is start ROM 99 which generates a binary word which, when fed to comparator 101, produces a pulse on the appropriate count ABCDEF produced by master counter 91, which is synchronized with the scanning of the entire keyboard. Comparator 101 operates by simply comparing the left side count inputs with a six bit binary word on the right side. When a compare condition is reached, an output pulse is fed to recirculating twelve bit shift register 102 through OR gate 103. Since shift register 102 is of the recirculating type, the output bit will be fed back to the input to be again shifted through the register, in synchronism with the scanning of each octave of the keyboard.

Solo fill note ROM 104 is twenty-four lines by eleven lines wherein the nine lines 105 of the eleven are connected as inputs to ten bit shift register 106, which is clocked at the high frequency clock rate. The output of shift register 106 is fed to the solo fill note data on/off block 96 which is a simple gating circuit which either passes or blocks the serial solo fill note data on line 107 from reaching solo data summing gate 108. The control for gate 96 is on line 109 together with either CT2 or CT2', depending on whether the system is in the large organ or small organ mode, respectively. Solo fill note data is permitted to pass to block 108 only when the organ is in the chord mode.

Returning to shift register 102, it is synchronized with the scanning of the keyboard and, depending on the programming of ROM 99, the recirculating bit generated by comparator 101 will be inserted in shift 102 in a time slot corresponding to the respective chord playable on the accompaniment manual 30. When a solo data pulse appears on line 110 as the manual 22 is scanned in descending fashion, major/minor data routing circuit 112 will momentarily enable either the twelve vertically represented major lines of ROM 104 or the twelve vertically represented minor lines of ROM 104. Routing circuit 112 is a simple gating circuit which ands together the pulse on line 110 and the logic level on select line 113 to activate either the major lines or the minor lines, which are paired together with single outputs of shift register 102. The select signal on line 113 is brought into chip 20 from line 80 (FIG. 3) on pin P8.

Of the twelve vertical lines which are enabled by routing circuit 112, only one will be activated depending on which of the twelve outputs 114 of register 102 is activated by the pulse circulating therethrough. When the appropriate vertically representing line is activated, two bits will be loaded into shift register 106, which bits are in the proper time slots for the fill notes corresponding to the chord selected by decoder 98. These pulses will then be summed with the solo pulse on line 92 and fed out of chip 20 on pin P13.

By way of example, assume that a C chord is selected on accompaniment manual 20 and the performer depresses high C on the solo manual 22. The selection of a C chord will cause ROM 99 to generate four bits of a six bit word producing a compare condition at comparator 101 in the time slot corresponding to each C key of the keyboard, for instance, which will activate output 115 of shift register 102 also during this time slot, which reoccurs each octave of the keyboard. The next successive output 115*a* of shift register 102 will be activated during the time slot corresponding to each B key of the keyboard, the third successive output (not shown) of shift register 102 will be activated during the time slots corresponding to the A sharp keys of the keyboard, and so on. Since the high C key 22*a* on the solo manual 22 has been depressed, a keydown pulse will appear on line 110 in the time slot corresponding to high C and major/minor data routing circuit 112, since a major chord was selected, will enable the twelve vertical major lines in ROM 104 at the precise time output 115 is activated and major line 116 will be activated and pulses will appear on horizontal lines 117 and 118, which correspond to the fifth and eighth keys following high C. These keys are the G and E keys, respectively, which are the fill notes for a C chord when a C key is played on the solo manual. It is apparent that these bits will be loaded on the solo data stream on pin P13 in the appropriate time slots.

If the B key 22*a* immediately below high C were depressed in the solo manual 22, lines 119 and 120 would be activated by ROM 104 because the G and E keys are separated from the depressed B key by intervals of four keys and seven keys, respectively. Lines 119 and 120 would be activated by virtue of the second output 115*a* of shift register 102 being activated when the solo data pulse appears on line 110. Of course, the selection of different chords on the accompaniment manual 30 results in ROM 99 producing a compare condition at comparator 101 in a different time slot so that the recirculating bit in shift register 102 will also be relocated to the appropriate time slot.

The provision of separate sets of vertical lines for the major and minor chords is necessitated by the fact that the musical third in a minor chord is flatted thereby changing the interval for this note by one key. The following chart shows the musical intervals of the fill notes for the various notes played on the solo manual for C major and G major chords:

| KEY DEPRESSED ON SOLO MANUAL | B | C | D | D# | E | F | F# | G | G# | A | A# |
|---|---|---|---|---|---|---|---|---|---|---|---|
| FILL NOTE INTERVALS | 5 | 6 | 7 | 3 | 4 | 5 | 2 | 3 | 4 | 5 | 6 |
| C CHORD | 8 | 9 | 10 | 8 | 9 | 10 | 6 | 7 | 8 | 9 | 10 |
| FILL NOTE INTERVALS | 5 | 2 | 3 | 4 | 5 | 6 | 4 | 5 | 6 | 7 | 3 |
| G CHORD | 10 | 6 | 7 | 8 | 9 | 10 | 7 | 8 | 9 | 10 | 8 |

An alternate solo chord scheme is shown in FIG. 4B wherein the major/minor selection is accomplished at the output of ROM 104 by means of nine 1 of 2 data selectors 122*a* controlled by the signal on line 123*b*.

Also receiving the solo data pulses from line 110 is the solo oxxy debounced pulser 121 (FIG. 4) which simply produces a solo pulse each time a solo key 22*a* is depressed and no pulse when the key is released. Shift register 102 is cleared by a signal from clear circuit 122 both when a master reset pulse is received and when count 44 is reached at the end of the solo manual scan.

Figure 5:
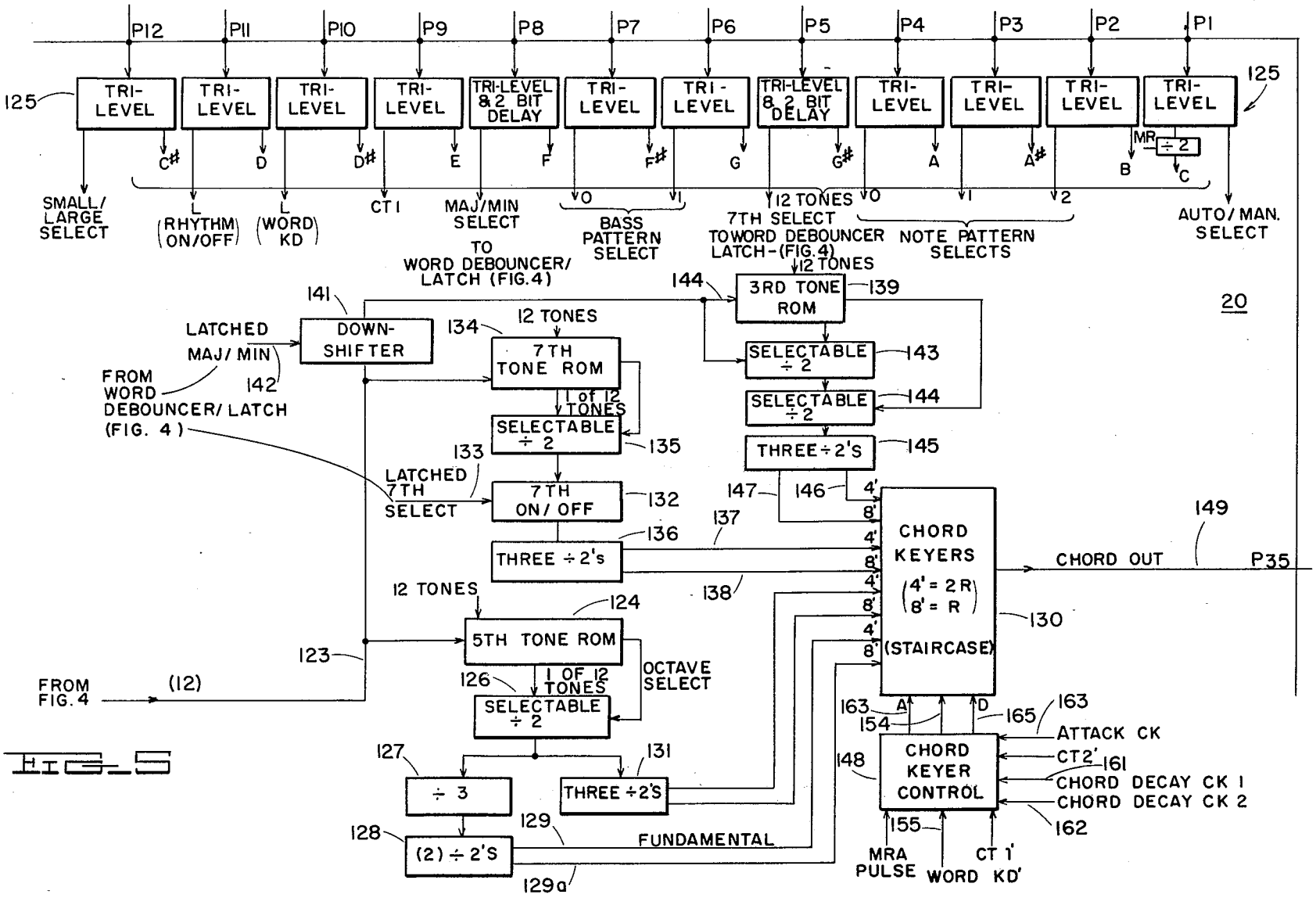
FIG. 5 is a more detailed block diagram of the chord generation system.

Referring now to FIG. 5, the chord select signal from decoder 98 is transmitted to the tone section, shown in FIG. 5, over line 123. It is a well known fact that the third harmonic of the tone is approximately equal to the musical fifth and is accurate within a very few cents. In the chord generation system, therefore, the musical fifth is generated and then divided by three to produce the fundamental and is the basis of operation of the fifth tone ROM 124. ROM 124 is fed by the twelve tones of the top octave which come in on pins P1 through P12 and are subsequently decoded by tri-level decoders 125, which were discussed previously. Depending on which chord is decoded by decoder 98, ROM 124 will produce the fifth tone for that chord on line 126 which is passed through a selectable divide-by-two; this enables selection of the octave for the fifth and fundamental. The octave select is also controlled by ROM 124. This tone is passed through divide-by-three circuit 127 and then two divide-by-two circuits 128. The input and output of the last divide-by-two serves to produce a 4 foot component on line 129 and an 8 foot component on line 129*a*, which are added together in a staircase keyer 130.

The musical fifth tone is fed through its own divide-by-two dividers 131 with the 4 foot and 8 foot components thereof fed to their respective 4 foot and 8 foot inputs to staircase keyer 130.

The seventh tone select system works similar to the fifth tone ROM 124 except that there is the additional function of a seventh select on/off block 132 which is controlled by the seventh select signal on line 133. Seventh tone ROM 134 is fed by the same twelve tones as fifth ROM 124 and is followed by a selectable divide-by-two divider 135 so that the proper octave may be realized. The seventh select line comes into chip 20 on pin P5 and is decoded by tri-level decoder 125. When a seventh chord is not selected by virtue of the appropriate signal not being present on line 81 (FIG. 3), its tone is blocked thereby preventing the three divide-by-two dividers 136 from running. If a seventh chord is selected, however, the three divide-by-two dividers 136 will run and produce the 4 foot and 8 foot components of the seventh tone on lines 137 and 138, which are connected to their respective keyers 130.

The third tone ROM 139, which is also fed by the twelve tones on pins P1 through P12, receives the chord select signal on the one of its twelve input lines 144 which is first passed through down-shifter 141. Down-shifter 141 is controlled by the major/minor select signal on line 142 from pin P9 and electronically moves the twelve input lines down one line on ROM 139. In other words, in the case of a C minor chord being selected, for example, the note to be flatted is E and when it is flatted, it will be shifted down to D sharp. The output of third tone ROM 139 is a single tone passed through selectable divide-by-two divider 143, selectable divide-by-two divider 144 and three straight divide-by-two dividers 145 so as to produce the 4 foot and 8 foot components of the musical third tone on lines 146 and 147.

Chord keyers 130 and their respective chord keyer control circuits 148 produce on chord out line 149 the three or four tones corresponding to the chords selected on the accompaniment manual 83. Circuits 130 and 148 are shown in detail in FIG. 7.

Chord keyers 130 and chord keyer controls 148 together form a modified version of the keyer disclosed in Application Ser. No. 736,256 filed Oct. 27, 1976. When the system is in the chord mode, and gate 150 (FIG. 7) will produce a logic level 1 on lines 151 and 152 and, assuming that the MRA function is disabled, a logic 1 on line 153 will result in a pulse on line 154 each time that a word keydown signal appears on line 155. The tone input to the keyers is brought in on its respective input line, the 8 foot fundamental input line 128, for example, which is connected to the gate of FET 155. The sustain portion of the circuit comprises an inverter 156 having its output connected to the gate of FET 176. The output of OR gate 177 is connected to the source terminals of FETs 158 and 159 and to the gate of FET 160.

Three internally generated clock pulse trains are brought into the keyer from lines 161, 162, and 163 so as to control the long decay, short decay and attack characteristics of the keyer. The long decay pulse on line 161 is anded together with the CT1′ off signal on line 164 and produces a pulse train on line 165 at the output of OR gate 166. The short decay pulse train on line 162, which is of a higher frequency than the long decay pulse train on line 161, is anded together in gate 167 with the CT1′ on signal on line 164. It will be recalled that a CT1′ on signal will be present when the MRA pulse function is enabled. Line 165 is connected to the gate of FET 158, and is connected to the gate of FET 168 through inverter 169. The attack pulse train on line 163 is connected to the gates of FET 159 and FET 170, the latter through inverter 171.

A capacitor 172 is connected between the interconnected terminals of FETs 158 and 168, capacitor 173 is connected between the interconnected terminals of FETs 159 and 160, and capacitor 174 is connected between FET 160 and the gate of FET 175, the latter being connected to chord out line 149. FET 176 is connected between FET 168 and capacitor 174 and has its gate terminal connected to the output of OR gate 177.

As can be seen, the signal connected to the gate of FET 158 is the logic compliment of the signal connected to the gate of 168 and is either at the higher frequency short decay pulse rate or the lower frequency long decay pulse rate as determined by the CT1′ signal on line 164. As the clock train on line 165 cycles from logic 1 to logic 0, the voltage developed at the gates terminals of FETs 158 and 168 will cause the resistance values between the source and drain terminals of FETs 158 and 168 to alternate between high and low levels of resistance. The same operation takes place with regard to FETs 159 and 160 at the attack clock frequency.

When an accompaniment key is depressed, a word keydown signal on line 155 will develop a logic level 1 on line 154. As FETs 159 and 160 are rendered alternately conductive and non-conductive by the attack pulses on line 163, the voltage on line 154 will gradually and incrementally be transferred to capacitor 174 via capacitor 173. When the first attack clock pulse is detected by the gate of FET 159, it will be rendered conductive and capacitor 173 will charge. During the next half cycle, the signal on line 154 changes to logic level 1, the resistance between the source and the drain terminals of FET 159 will be at a low value and a voltage on FET 159 will be turned off and FET 170 will be turned on so that capacitor 173 will discharge through FET 170 into capacitor 174. During the next positive half cycle of the attack train, FET 159 will again be turned on and the voltage on line 154 will again charge capacitor 173 through FET 159, and so on until the voltage level on line 154 is completely transferred to capacitor 174 at which point FET 175 will be fully turned on. This causes the tone frequency voltage developed by FET 155 under control of its own signal on line 128 to be passed onto line 149 with an attack characteristic determined by the ratio of capacitors 173 and 174, the characteristics of FETs 159 and 160 and the frequency of the attack pulse train on line 163.

When the key is released, a logic level 0 will appear on line 154 thereby turning on FET 176 and turning off FET 160. AND gate 178 will pass the long decay pulse train on line 161 which will cause FETs 158 and 168 to become alternately conductive so as to incrementally and gradually discharge the voltage on capacitor 174 through FETs 176, 168 and 158 and capacitor 172 to logic level 0, which is the voltage level on line 154. This will cause the tone on line 149 to decay out at a rate determined by the ratio of capacitors 172 and 174, the characteristics of FETs 158 and 168, and the frequency of the pulse train on line 161.

If the system is in the MRA mode whereby the tones are keyed by rhythmic MRA pulses, the CT1' signal and the $\overline{CT2'}$ signal will be at logic level 0 and MRA pulses will appear on line 179 with a rate and pattern determined by the rhythm section. Additionally, gate 178 will be disabled and gate 167 enabled so that the short decay pulse train on line 162 controls FETs 158 and 168. This will result in the decay characteristic for the tone signal on line 128 to have a shorter time constant. Of course, the keying of the tones will not be determined only by the keydown signals on line 155 but also by the presence of MRA pulses on line 179.

Plural lines 180, 181 and 182 represent connections to the other seven identical chord keyers controlled by chord keyer control circuit 148.

Figure 6B:
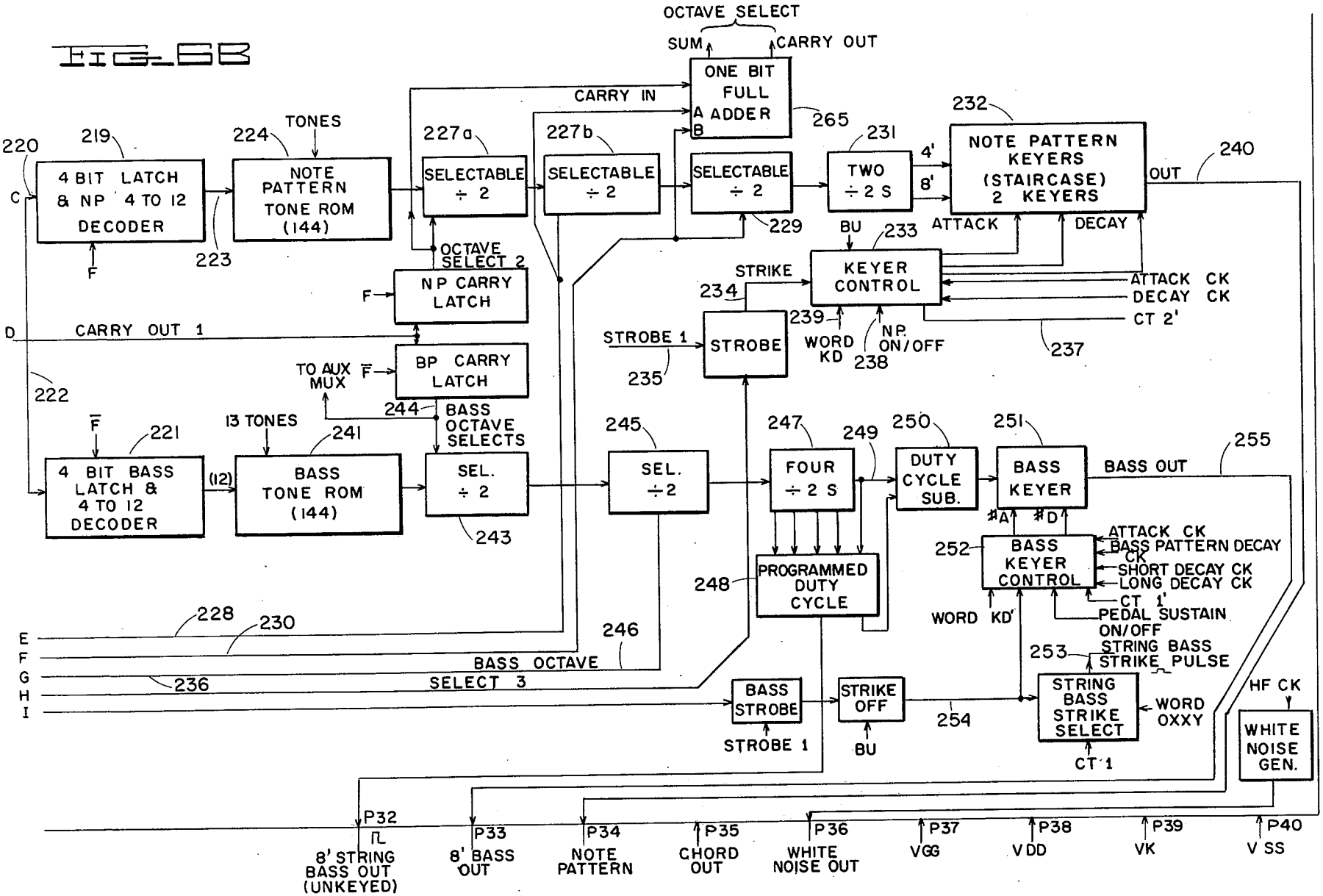

In FIGS. 6A and 6B, a system is shown which enables the automatic playing of bass patterns and/or keyboard note patterns in accordance with patterns stored in read only memories. The latched root word from word debouncer and latch 95 (FIG. 4) is transmitted to one input of modulo 12 adder 184. This word is known as the root word and is the starting point for the bass and note patterns. The other input to adder 184 is a four bit word on line 185 from add word select block 186 and represents an interval away from the root word on line 183. A series of these add words are generated by the system shown in FIG. 6A in accordance with a preselected rhythm pattern.

Figure 8:
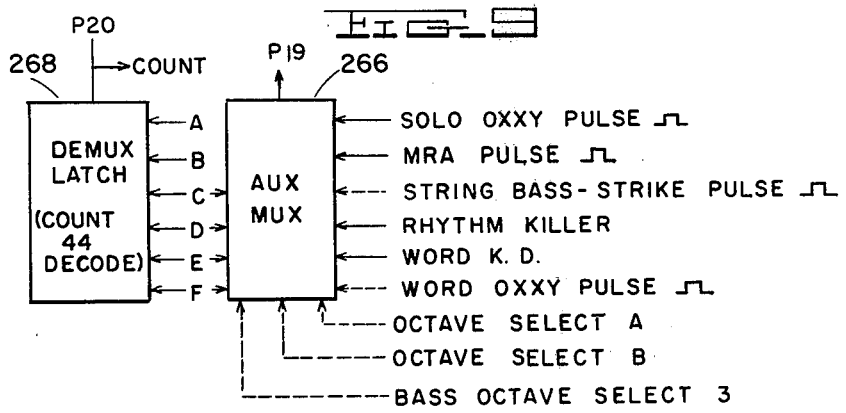
FIG. 8 is a circuit schematic of the rhythm counter.

The rhythm pulses are generated by the rhythm counter 187 (FIG. 6A), which is a five bit thirty-two state counter and may take the form shown in FIG. 8. When the selected rhythm pattern is in 4/4 time, counter 187 will produce on its five output lines 188 thirty-two five bit binary words which together represent two rhythm measures. In $\frac{3}{4}$ time, however, each measure consists of twelve counts rather than sixteen counts so that it is necessary to skip certain counts. This is accomplished by the count elimination circuit 191 comprising gate 189, which functions to delete counts 7, 8, 15, 16, 23, 24, 31 and 32. Circuit 191 is activated by ROM 193 which decodes the twelve rhythm patterns on lines 93.

Counter 187 feeds a binary to decimal decoder 194 which is a one-to-thirty-two decoder having thirty-two output lines 195 for sequentially addressing rhythm pattern ROM 196 as the successive binary states of counter 187 are attained. Latch 197 assures that if the rhythm unit is turned off during the playing of a rhythm pattern, the pitches will not be terminated instantaneously but will hold until the sound decays away.

Buttons up ROM 198 detects whether all of the rhythm buttons or switches are non-actuated and provides a preset signal on line 199 to decoder 194 which forces it to the first count state so that everything is in the root mode and assures stability for the system.

The thirty-two input lines 195 for rhythm pattern ROM 196 feed completely through bass pattern ROM 200 and note pattern ROM 201 so that each of these ROMs are addressed simultaneously.

The selected rhythm pattern results in a signal on one of lines 202 and enables the appropriate section of rhythm pattern ROM 196. Six outputs from ROM 196 are strobed and then fed out of chip 20 on pins P25 through P30. As is well known in rhythm units, the six outputs are pulsed in a variety of selected patterns and transmitted to voicing circuits which produce the rhythm sounds such as those produced by a snare drum, cymbal crash, wood block, etc. The solo rhythm repeat pulses are fed out on line 203, strobed and then transmitted to pin P31. The MRA pulses which were discussed earlier, are fed out on line 204 and subsequently strobed for use as control pulses at various other points in the system.

The strobe system is a two phase system which produces a wide strobe pulse and a narrow strobe pulse. The narrow strobe pulse is transmitted to strobe circuits 206 and 207 and the wide strobe pulse to circuit 205 and keyers outside chip 20.

The bass pattern in ROM 200 and the note pattern in ROM 201 are selected in one of two ways. One of these is to automatically select the patterns depending on which rhythm button is depressed. This information is fed into priority gating circuit 208 from line 93 which enables only one rhythm to be selected even though more than one rhythm button is depressed, for example, the furthest button to the left or the right of those which are depressed. The auto bass pattern is selected by ROM 209 and the auto note pattern by ROM 210, which can be programmed to match rhythm patterns with bass patterns and note patterns in any desired fashion. The four lines from auto bass pattern ROM 209 are passed through auto/manual gating circuit 211 which allows the select data on the enable line to be passed to $\frac{3}{4}$ override 212 when the system is in the automatic mode. Gating circuit 213 receives the eight lines from ROM 210 and allows the data on the selected line to be passed to $\frac{3}{4}$ override 214 when the system is in the automatic mode.

If the system is in the manual mode, the bass pattern is selected by a two bit binary word at the input of manual bass pattern decoder 215 and passed by gate 211 to $\frac{3}{4}$ override 212. This two bit binary word comes into chip 20 over pins P7 and P8 and permits the selection of one of four 4/4 bass patterns. In the manual mode, the manual note pattern information is brought into chip 20 over pins P2, P3 and P4, is decoded by decoder 216 and is passed by gate 213 to $\frac{3}{4}$ override 214.

This data is presented to bass pattern ROM 200 by the enablement of one of the five vertically represented lines. $\frac{3}{4}$ override circuit 212 automatically forces ROM 200 into a pattern compatible with $\frac{3}{4}$ time in the event that a $\frac{3}{4}$ rhythm is selected but a 4/4 pattern is selected on pins P6 and P7. The enabled line of ROM 200 has a plurality of address points which are sequentially addressed by the thirty-two input lines 195. These address points will include "note played" or "no note played" information depending on the makeup of the particular bass pattern which is programmed thereon.

Note pattern ROM 201 is similar to bass pattern ROM 200 and comprises eight vertically represented lines each having address points which contain "note played" or "no note played" information depending on the particular pattern programmed thereon. These address locations are similarly addressed in sequence by the thirty-two input lines 195. $\frac{3}{4}$ override 214 forces ROM 201 to a $\frac{3}{4}$ pattern if a $\frac{3}{4}$ rhythm is selected but a 4/4 pattern is selected (only in the auto mode) on pins P2, P3 and P4.

Bass pattern ROM 200 produces a series of four bit binary words on lines 217 which are presented to one input of add words select 186. The data from note pattern ROM 201 is fed to the other input of add word select 186 as a four bit word over lines 218. Lines 217 and 218 are time division multiplexed under the control of the most significant bit output F of master counter 91 (FIG. 4). Thus, on one half-scan of the keyboard, the four bit word representing a note interval from bass pattern ROM 200 is presented to modulo 12 adder 184 and on the other half-scan, the four bit word from note pattern ROM 201 is presented thereto. This time sharing of modulo 12 adder 184 enables a substantial increase in capacity of the system without a corresponding increases in circuitry. Thus, adder 184 receives a four bit word from root word ROM 100 which is dependent on the chord which is selected and at a note interval on line 185 which is dependent on the selected bass pattern during one half-cycle of the scan, and on the selected note pattern during the other half-cycle of the scan. Adder 184 takes the root word and adds to it a word which is a note in a pattern, represented as a certain interval from the root word. Thus, all of the patterns are compatible with any chord which is selected since it is the interval which is important rather than the absolute value of the note. For example, if binary 0001 is adder to the root note word, it will move up by one note, if binary 0010 is added to it, it will move up by two notes.

With reference to FIG. 6B, this word is fed to the input of latch and decoder 219 over line 220 and to the input of latch and decoder 221 over line 222. Since adder 184 is time shared, latch 219 will be enabled during time F, and latch 221 will be enabled during time $\overline{F}$ for the note pattern and bass pattern, respectively. Decoder 219 enables one of its thirteen output lines 223 which are fed into note pattern tone ROM 224, which in turn is fed by the twelve tones from pins P2–P12 and feeds the selected tone into selectable divide-by-two divider 227*a* which is activated by the carry from adder 184 latched during time F. This causes the pattern to move from one octave to the next in sequence and provides a two octave direct span for the note pattern. The third octave is achieved by selectable divide-by-two divider 227*b* which is enabled by a signal on line 228 and prevents wraparound when the thirty-two step note pattern repeats itself on the third measure. Divider 229 provides the fourth octave and is generated by a signal on line 230 from note pattern ROM 201. Of course, certain patterns may not encompass the entire four octaves, for example a boogie pattern, so that divide-by-two dividers 227*b* and 229 may not be disabled.

Final dividers 231 divide down to place the notes in the proper pitch and feed a pair of staircase keyers 232 at the 4 foot and 8 foot pitches. Keyers 232 are controlled by control circuit 233 and are very similar to that shown in FIG. 8. The tones are keyed by a strike signal on line 234 strobed by a control signal on line 235. The strike pulse is generated by ROM 201 and placed on line 236 and may occur for a single beat or more than one beat depending on the pattern. Control circuit 233 ands together the CT2′ signal on line 237, the note pattern on/off signal on line 238, the word keydown signal on line 239 and the strike pulse on line 234. The tones out from keyers 232 are connected to pin P34 over line 240.

One of the thirteen output lines from decoder 221 is enabled during time $\overline{F}$ and selects a single tone in ROM 241, which is fed by the twelve top octave tones coming into chip 20 on pins P2–P12 and the divided down C tone. The selected tone is fed to selectable divide-by-two divider 243 which is enabled by a signal on line 244 latched during $\overline{F}$ time by the carry signal from adder 184 so as to prevent wraparound and enable two octaves to be played in succession. Divider 243 feeds a third selectable divide-by-two divider 245 which is enabled by a signal on line 246 and provides the third octave for the bass pattern.

Four divide-by-two dividers 247 are fed by the tone from divider 245 and bring out the bass tone in the proper pitch which is an 8 foot output in the 64 Hz. to 256 Hz. range. Dividers 247 also provide a duty cycle control as determined by programmed duty cycle circuit 248, which may be of any suitable design, for example that disclosed in U.S. Pat. No. 3,992,973. The system as shown produces an 8 foot string bass output which is achieved by programming circuit 248 to produce a pulse train having a $37\frac{1}{2}$% duty cycle. Since this output is unkeyed, it can be used for an external divider and keyer to produce a 16 foot pedal.

The normal 8 foot output on line 249 also has a duty cycle control by way of circuit 250 and activates keyer 251, which is controlled by bass keyer control circuit 252. Keyer 251 and control 252 are very similar to those shown in FIG. 8, but has three decays: a long decay, a short decay and a bass pattern decay. The long decay is controlled by the pedal sustain on/off line multiplexed in on lines 79. The CT1′ input functions similarly to that in the keyer and control shown in FIG. 8 except that either the string bass pulse on line 253 or the bass strobe pulse on line 254 generated by the pattern selected in ROM 200 is used, depending on whether the system is in the bass pattern mode or not. The keyed bass tone out is connected to pin P33 over line 255.

Returning now to modulo 12 adder 184, it includes a carry in line 256 which is normally enabled, but is disabled if desired, when the major/minor line 257 from pin P8 goes minor. What is done, is that the system looks at the output of the word select 186, which is decoded by flat ROM 258 to monitor those words which are normally flatted. For example, the musical third during a minor chord is always flatted. Additionally, certain notes in certain of the patterns are programmed to be flatted and those patterns are detected by flat override ROMs 260 and 261 for the bass patterns and note patterns, respectively, and are time shared by the F and $\overline{F}$ enabling signals thereto. The flat overrides are activated when a particular note in one pattern is flatted whereas in another pattern it is not flatted. When a note is flatted, the carry for modulo 12 adder 184 is removed. The outputs from flat overrides 258 and 261 are passed through flat gate 262 which in turn provides one of the inputs to flat enable circuit 263. An alternate scheme is to convey the flatting information with extra outputs from the pattern ROM's 200 and 201, as shown in FIG. 6C.

One bit full adder 265 provides a two bit binary word output to auxiliary multiplexer 266 conveying information regarding the particular octave which the note pattern system is in. This is in case it is desirable to perform flute filtering outside chip 20, which requires a separate filter for each octave.

Figure 10:
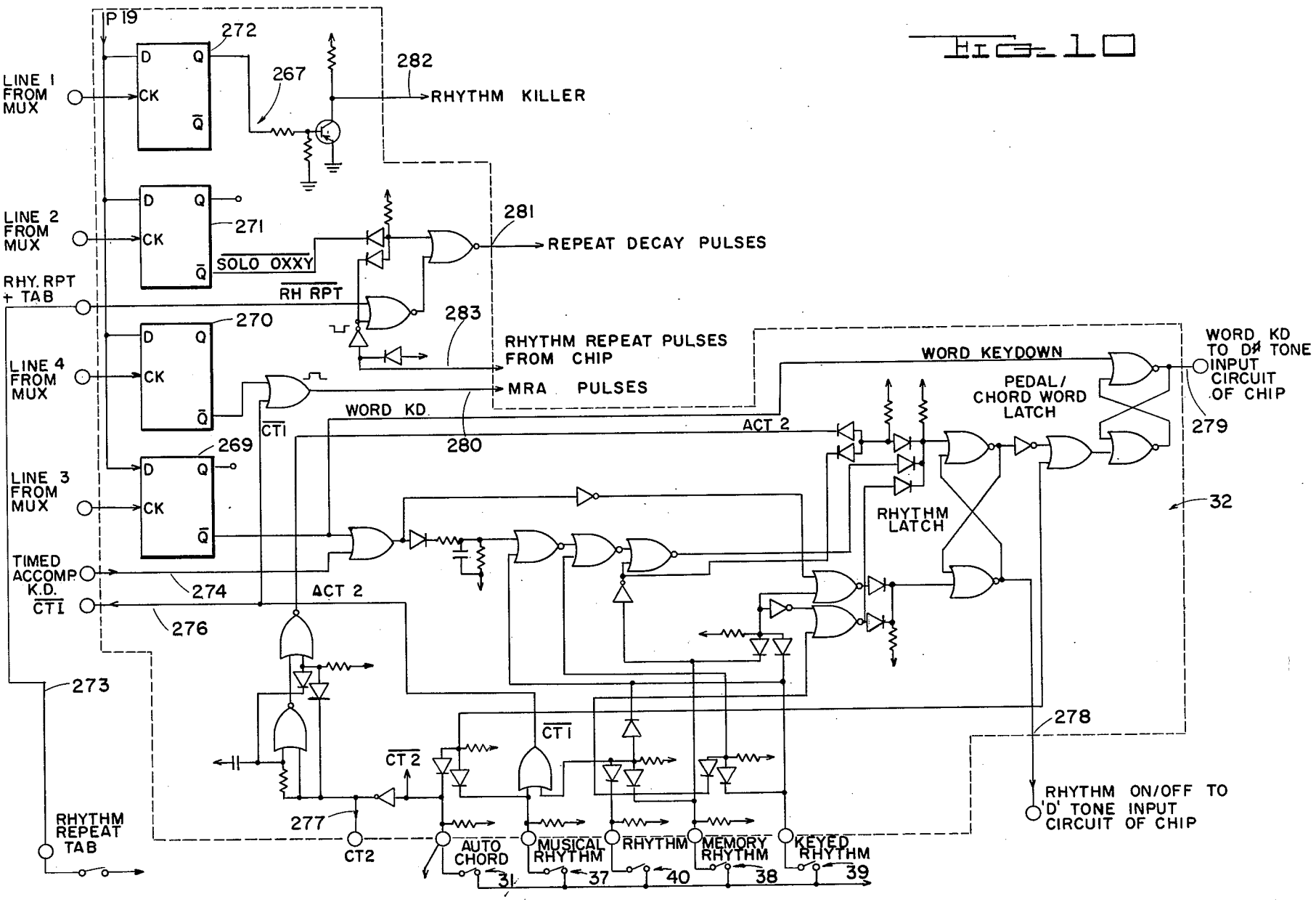
FIG. 10 is a detailed circuit schematic of the external demultiplexer logic and latching controls.

Referring now to FIGS. 9 and 10, the auxiliary multiplexer 266 and auxiliary demultiplexer 267 will be described. Auxiliary multiplexer 266 is fed by the solo oxxy pulse from word debouncer and latch 95, the MRA pulse from strobe circuit 207, the rhythm killer signal and the work keydown signal from ROM 97. Other selectable inputs to auxiliary multiplexer 266 are shown, for example the strike pulse, word oxxy pulse, note pattern octave selects A and B and the bass pattern octave select. This adds considerable flexibility to chip 20 in the event the system is expanded either internally or externally.

Multiplexer 266 is driven by the ABCDEF outputs of master counter 91 and is therefore in synchronism with the scanning of the keyboard. Latch 268 provides a count 44 decode on pin P20. The output of multiplexer 266 is provided to pin P19.

In FIG. 10 is shown the auxiliary demultiplexer chip including demultiplexer 267 which comprises four D flip flops 269, 270, 271 and 272. Flip flops 269, 270, 271 and 272 are clocked by lines 1, 2, 3 and 4 from multiplexer 74 (FIG. 3), and the data which is on their respective D inputs at the time they are clocked will appear at their Q and $\overline{Q}$ outputs. The clocking of flip flops 269 to 272 by the outputs of multiplexer 74 is in synchronism with the four most significant bits of master counter 91.

Other inputs to the auxiliary demultiplexer chip of FIG. 10 are the rhythm repeat tab on line 273, the accompaniment keydown signal on line 274, chord switch 31, musical rhythm switch 37, rhythm switch 40, memory rhythm switch 38 and keyed rhythm switch 39. Outputs from the chip include the $\overline{CT1}$ signal on line 276, the CT2 signal on line 277, the rhythm on/off signal on line 278, the word keydown signal on line 279, MRA pulses on line 280, repeat decay pulses on line 281 and rhythm killer signal on line 282. Rhythm repeat pulses from chip 20 are fed into the circuit on line 283.

Of course, other inputs to auxiliary multiplexer 266 could be provided and these would be demultiplexed by adding additional D flip flops together with the necessary gating circuitry to retrieve the desired outputs.

Figure 12:
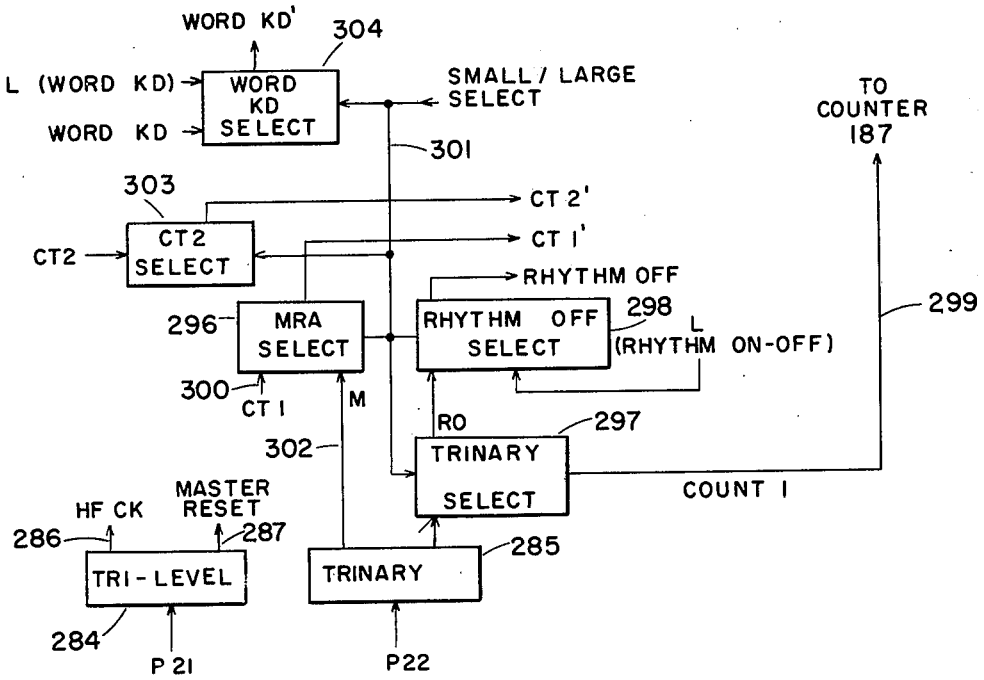
FIG. 12 is a block diagram of the input for the system control.

Referring to FIG. 12, it is seen that pins P21 and P22 are brought into trinary decoder 284 and trinary 2 decoder 285, respectively. Trinary decoder 284 brings off from pin P21 the high frequency clock pulse train on line 286 and the master reset on line 287.

Trinary 2 decoder 285 has two separate modes of operation, one for use in a large organ configuration and the other for use in a small organ configuration. In the small organ mode, trinary decoder 285 switches CT1′ on through MRA select 296 and switches the internal rhythm unit off through trinary 2 select 297 and rhythm off select 298, when in its first state, it switches the rhythm unit on and CT1′ on when in its second state, and switches the rhythm unit on and CT1′ off when in its third state. In the large organ mode, these particular controls are not needed and pin P22 becomes free. In this mode, an external rhythm unit can be used with the internal system and to assure synchronization, a rhythm count one signal is transmitted to counter 187 over line 299. This signal comes in on pin 22 and passes through trinary 2 decoder 285 and trinary 2 select 297. This assures that the external rhythm unit and the internal rhythm system are always in synchronization.

MRA select 296, which is a two input, one output data selector which selects either the CT1 input on line 300, which is brought in on pin P9 in the large organ mode, or, in the small organ mode is activated by trinary 2. The large organ/small organ select for MRA select 296 is transmitted over bus 301, which is connected to pin P12. It should be noted that the primed control signals, such as CT1′, CT2′, Word KD′, etc., are used only internally of the chip. The CT1 signal, which it will be recalled is the control signal which enables the rhythmic MRA pulses for automatically keying the tones generated internally of the chip, is brought in externally on pin P9 in the large organ mode and redesignated CT1′ internally of the chip. CT1′ is turned on by the signal on line 302 when the system is in the small organ mode.

Trinary 2 select 297 is a one input, two output data selector which provides a count one signal on line 299 in the large organ mode and provides a rhythm on/-rhythm off signal to rhythm off selects 298 in the small organ mode. In the large organ mode, rhythm off select receives the rhythm on/off signal from pin P11, which is latched by an external RS latch. Rhythm off select 298 is a two input, one output data selector.

CT2 select 303 is a one input data selector wherein the CT2 signal brought in on the multiplexed four bit byte is selected and redesignated CT2′ in the large organ mode. In the small organ mode, CT2′ is on constantly. Work keydown select 304 is a two input, one output data selector and in the large organ mode, the latched word keydown from pin P10 is selected and fed out as Word KD′. In the small organ mode, the internally generated word keydown signal from ROM 97 is selected and similarly redesignated Word KD′.

Figure 11:
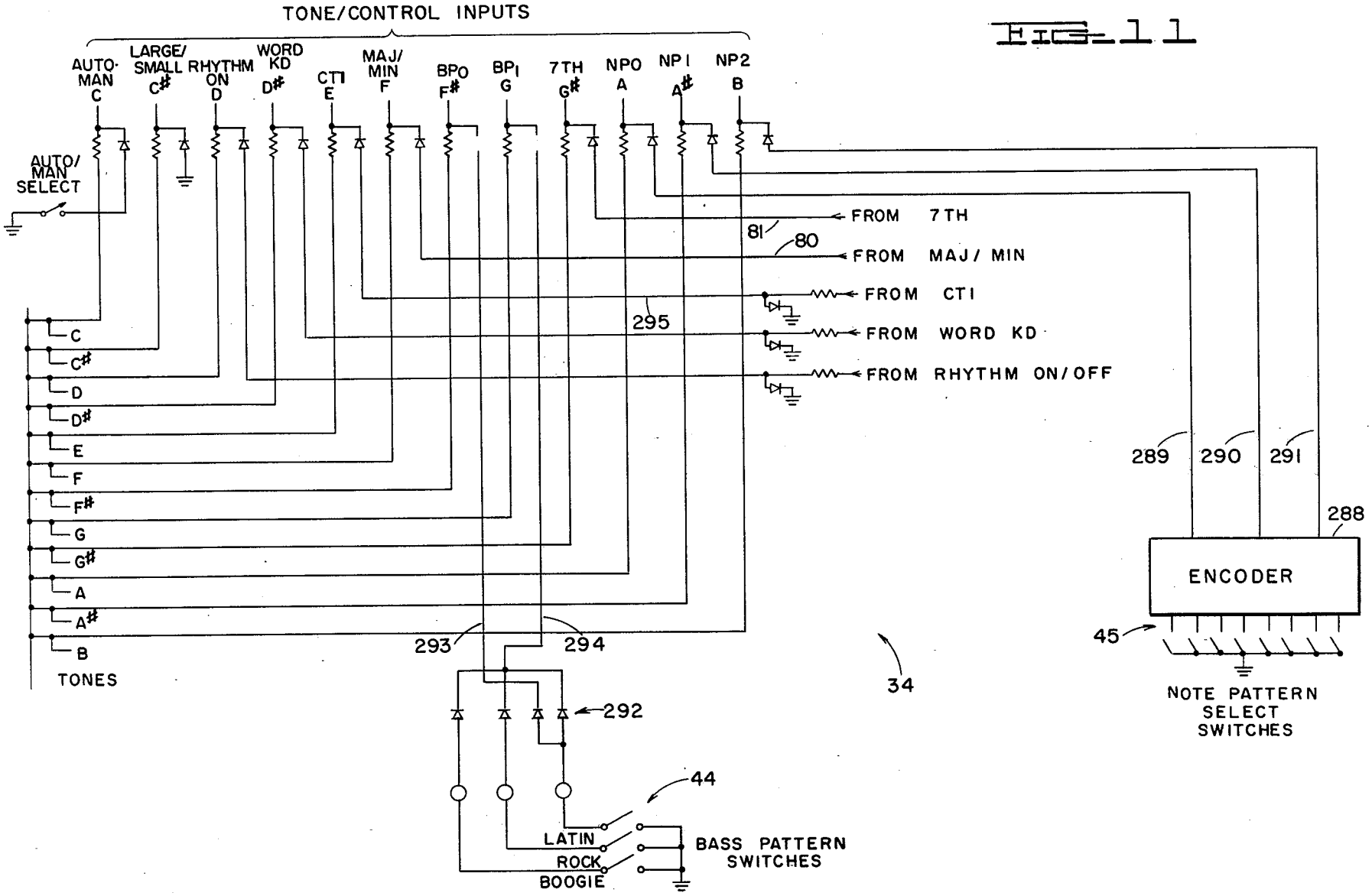
FIG. 11 is a circuit schematic for the combiner block of FIG. 1.

FIG. 11 illustrates the block denoted "COMBINER" in FIG. 1 and shows how the twelve tones and the various control inputs are brought into chip 20 on the pins P2–P12. The note pattern select switches 45 are binary encoded by encoder 288 and brought into chip 20 on pins P2, P3 and P4 over lines 289, 290 and 291. This binary word is combined with the A, A# and B tones for subsequent decoding by the appropriate tri-level decoder 70. The bass pattern switches 44 are encoded by encoder 292 and are connected to chip 20 as a two bit binary word on lines 293 and 294. The F# and G tones are brought into chip 20 at the same points, which are pins P6 and P7.

The seventh select line 81 and the major/minor select line 80 (FIG. 3) are combined with the G# and F tones on pins P5 and P8. The CT1 signal on line 295 is combined with the E tone on pin P9. The word keydown signal and rhythm on/off control signal, which are used when the system is in the large organ configuration, are brought in on pins P10 and P11 together with the D# and D tones respectively. The small organ/large organ select signal is brought into chip 20 on pin P12 together with the C# tone.

In summary, the present system has been designed to enable it to be incorporated into a single, forty pin LSI chip. This is accomplished through extensive use of tri-level and trinary inputs wherein relatively high frequency signals are combined with static control signals. Additionally, multiplexing the keyboard, rhythm select switches and certain control functions onto a four bit byte data stream enables a great deal of player controlled information to be brought into the chip over a few pins. The chord tone generation, which is accomplished internally of the chip through a plurality of selectable dividers, is brought out over a single pin for accompaniment voicing.

A player selected note pattern may be played simultaneously with a player selected bass pattern by time sharing the logic circuitry and then bringing out these two series of notes on separate pins. Through the use of an internal auxiliary multiplexer, a great number of control functions may be brought out over a single pin for demultiplexing externally of the chip.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and fall within the limits of the appended claims.

What is claimed is:

1. An electronic organ comprising: a keyboard having a solo portion comprising a continuous succession of linearly arranged keys customarily played by the right hand of the performer and an accompaniment portion comprising a continuous succession of linearly arranged keys customarily played by the left hand of the performer, multiplexer means for scanning the keys of the solo portion of the keyboard and generating a plurality of concurrent synchronized parallel time division multiplexed serial data streams corresponding respectively to diverse portions of the solo portion of the keyboard and each comprising time slots corresponding on a one-to-one basis to the individual keys of their respective portion of the solo portion of the keyboard and having keydown signals in the time slots thereof corresponding to actuated keys of their respective portion of the solo portion of the keyboard, said accompaniment portion including certain keys corresponding respectively to various chords, and means responsive to the accompaniment portion of said keyboard for generating parallel format multiple bit chord words, said words corresponding on a one-to-one basis to said certain keys of said accompaniment portion of the keyboard and for placing one of the chord words on a plurality of said data streams when the accompaniment key corresponding to that chord word is actuated.

2. The electronic organ of claim 1 including tone producing and keying means responsive to said data streams for producing tones corresponding to actuated keys of the solo portion and tones corresponding to the tones of the chords corresponding to actuated keys of said accompaniment portion.

3. An electronic organ comprising: a keyboard including a solo manual and an accompaniment manual each having playing keys, multiplexer means for scanning the keys of the solo manual and generating a plurality of concurrent parallel time division multiplexed serial data streams each comprising time slots corresponding on a one-to-one basis to the keys of different portions of the solo manual and each containing keydown signals in time slots corresponding to actuated keys of the respective portion of the solo manual, said multiplexer means including means for generating parallel format multiple bit binary words corresponding respectively on a one-to-one basis to certain of the keys of said accompaniment manual and for placing any one of said words on said data streams when the accompaniment manual key corresponding to said one word is actuated.

4. The electronic organ of claim 3 wherein said certain accompaniment manual keys correspond respectively to chords, and including means for generating the tones of the chords corresponding to said actuated accompaniment manual keys when said any one binary word appears on said data streams.

5. The organ of claim 4 including non-playing key control switches, and wherein said multiplexer means scans said control switches and places signals on said data streams in time slots corresponding to actuated ones of said switches.

6. An electronic organ comprising:

a keyboard having playing keys, multiplexer means for scanning said keys and generating a plurality of concurrent parallel time division multiplexed serial data streams each comprising time slots corresponding on a one-to-one basis to the keys of diverse portions of said keyboard and each containing keydown signals in time slots corresponding to actuated keys of the respective portion of said keyboard, clock means, counter means clocked by said clock means and generating a series of multiple bit counts having most significant bits and least significant bits, demultiplexer means for demultiplexing one portion of each of said data streams, and multiplex receiver means for receiving said data streams and being responsive to the other portions of said data streams to convert the other portions of said data streams to a single time division multiplexed serial data stream, said demultiplexer means being driven by the most significant bits of said counts and said multiplex receiver means being driven by the least significant bits of said counts.

7. The organ of claim 6 wherein said keyboard comprises a solo manual and an accompaniment manual, the other portion of said data streams comprises time slots corresponding to the keys of the solo manual, and said multiplex receiver is enabled for only a certain number of counts of said counter.

8. The organ of claim 6 wherein said demultiplexer means comprises a plurality of multiple bit latch means and means for enabling said latch means in succession and synchronism with the most significant bits of said counts, and each of said latch means includes latches connected respectively to said data streams.

9. An electronic organ comprising:

a keyboard having playing keys constituting a solo manual and an accompaniment manual and wherein certain of the keys of said accompaniment manual correspond respectively to chords playable by the organ, a plurality of player operated control switches, multiplexer means for scanning said solo manual and said control switches and generating a plurality of concurrent parallel time division multiplexed serial data streams corresponding respectively to diverse portions of said solo manual and said plurality of control switches, and containing signals in time slots corresponding to actuated keys and switches of their respective portions of said solo manual and said control switches, said multiplexer means including means for generating parallel format multiple bit binary words corresponding on a one-to-one basis to the chords playable by said certain accompaniment keys, and for placing the respective word on said data streams when one of said certain accompaniment keys is actuated, a single integrated circuit chip having pins and comprising: a plurality of input pins connected to said data streams, means providing to said chip tones corresponding in frequency to the twelve tones of an octave, means for generating the tones of the chord corresponding to said respective word when it appears on said data streams and for bringing said chord tones out of said chip on an external output pin of said chip, and means for converting a portion of said data streams comprising signals corresponding to the keys of said solo manual to a single solo time division multiplexed serial data stream and bringing said solo data stream out of said chip on a single pin.

10. The organ of claim 9 wherein said chip includes solo fill note generating means responsive to said solo data stream for placing on said solo data stream signals in time slots corresponding to the pitches of at least some of the tones of the chord corresponding to a depressed one of said certain keys in the accompaniment manual bit in the octave immediately below a solo key which is depressed.

11. The organ of claim 9 including means external of said chip for generating said twelve tones and wherein said chip includes twelve input pins connected respectively to said twelve tones.

12. The organ of claim 11 wherein said last mentioned pins are also connected respectively to twelve control signals and said chip includes tri-level decoder means to separate said twelve control signals from said tones.

13. The organ of claim 9 including a rhythm clock pulse train brought into said chip over an input pin and wherein said chip includes:

a memory in which a plurality of note patterns are stored, means connected to a plurality of pattern select pins on said chip and responsive to signals on said pattern select pins to select a pattern from said memory, rhythmic note pattern means responsive to said rhythm pulse train and the binary word corresponding to the depressed accompaniment key for generating a series of rhythmically timed tones according to the pattern selected from said memory, said series of rhythmically timed tones being brought out of said chip on a single pin.

14. The organ of claim 13 wherein said chip includes:

a rhythm pattern memory in which a plurality of rhythm patterns are stored, means connected to a plurality of rhythm select pins on said chip and responsive to signals on said rhythm select pins for selecting a rhythm pattern from said rhythm pattern memory, and means for bringing said selected rhythm pattern out of said chip over a plurality of pins connected respectively to diverse percussion voicing circuits externally of said chip.

15. The organ of claim 13 wherein said chip includes:

a rhythm pattern memory in which a plurality of rhythm patterns are stored, means connected with plurality of rhythm select pins on said chip and responsive to signals on said rhythm select pins for selecting a rhythm pattern from said rhythm pattern memory, wherein the rhythmic timing for said rhythmically timed tones is under the control of said selected rhythm pattern.

16. The organ of claim 13 wherein said rhythmic note pattern means includes a counter having means connected to one of said circuit chip pins for synchronizing said counter with a signal on said last mentioned pin.

17. The organ of claim 13 including means for synchronizing said rhythmic note pattern means with an external rhythm unit.

* * * * *